US008777339B2

(12) United States Patent
Tassin et al.

(10) Patent No.: US 8,777,339 B2
(45) Date of Patent: Jul. 15, 2014

(54) CABINETS AND MIRRORS SELECTIVELY MOUNTED ON HINGES SUPPORTING ROOMDOORS ON DOOR FRAMES, HINGES FOR SUCH MOUNTINGS, AND METHODS FOR SO MOUNTING

(75) Inventors: Timothy Wayne Tassin, Naples, FL (US); Myron Jude Tassin, Ocean Spirngs, MS (US); Christian Tassin, Gainesville, FL (US)

(73) Assignee: Hingenuity International, LLC, Naples, FL (US)

( * ) Notice: Subject to any disclaimer, the term of this patent is extended or adjusted under 35 U.S.C. 154(b) by 185 days.

(21) Appl. No.: 13/329,446

(22) Filed: Dec. 19, 2011

(65) Prior Publication Data

US 2012/0086318 A1 Apr. 12, 2012

Related U.S. Application Data

(63) Continuation-in-part of application No. 12/291,130, filed on Nov. 6, 2008, now Pat. No. 8,113,608.

(60) Provisional application No. 61/065,572, filed on Feb. 13, 2008.

(51) Int. Cl.
*A47B 46/00* (2006.01)

(52) U.S. Cl.
USPC ..... 312/249.2; 312/321.5; 211/119.004

(58) Field of Classification Search
USPC ..... 312/321.5, 405.1, 326–329, 138.1, 226, 312/227, 291, 249.2, 249.1, 249.7, 246; 211/119.004; 16/236, 354, 273, 387, 16/389, 260; 248/213.1
See application file for complete search history.

(56) References Cited

U.S. PATENT DOCUMENTS

| | | | | | |
|---|---|---|---|---|---|
| 714,686 | A | * | 12/1902 | Flint | 312/114 |
| 750,193 | A | | 1/1904 | James | 312/292 |
| 767,232 | A | | 8/1904 | McClung | |
| 1,006,481 | A | | 10/1911 | Johnson et al. | 312/225 |
| 1,212,028 | A | | 1/1917 | Dowling | 312/101 |
| 1,282,368 | A | * | 10/1918 | Behl | 160/328 |
| 1,464,352 | A | | 8/1923 | Cox | 297/14 |
| 1,485,714 | A | | 3/1924 | Roach | 312/300 |
| 1,543,980 | A | * | 6/1925 | Blood | 312/290 |
| 1,731,746 | A | | 10/1929 | Hunter | |
| 1,906,208 | A | | 4/1933 | Greenberg | 312/248 |
| 1,927,398 | A | | 9/1933 | Glasser | 62/377 |
| 1,980,730 | A | | 11/1934 | Matchette | |
| 1,991,951 | A | | 2/1935 | Matchette | 312/248 |
| 2,019,054 | A | | 10/1935 | Manz | 312/248 |
| 2,122,680 | A | | 7/1938 | Dart | 62/377 |

(Continued)

*Primary Examiner* — Janet M Wilkens
(74) *Attorney, Agent, or Firm* — The Livingston Firm; Edward M. Livingston, Esq.; Bryan L. Loeffler, Esq.

(57) ABSTRACT

A cabinet and a door are each provided with hinge sets having hinge parts secured thereto so that they can be separately mounted on the same hinge parts that are mounted on a door frame and are connected by a hinge pin for each hinge set that support the door on the door frame, using a single hinge pin for and as a part of each hinge set. With this mounting arrangement, the cabinet and the door of each such installation can move independently in an arc about the hinge pins connecting the door frame parts to the hinge parts fastened to the door and the hinge parts fastened to the cabinet without requiring the movement of the door concurrently with the movement of the cabinet.

3 Claims, 9 Drawing Sheets

(56) References Cited

U.S. PATENT DOCUMENTS

| | | | | | |
|---|---|---|---|---|---|
| D152,384 | S | | 1/1949 | Weaver | |
| 2,604,156 | A | * | 7/1952 | Lillethorup | 160/92 |
| 2,907,617 | A | | 10/1959 | Worrell | |
| 3,043,523 | A | * | 7/1962 | Hogstrom | 239/274 |
| 3,216,774 | A | * | 11/1965 | Figurski | 312/204 |
| 3,287,079 | A | | 11/1966 | Courson | 312/291 |
| 3,431,591 | A | | 3/1969 | Betso | 16/265 |
| 3,545,134 | A | | 12/1970 | Dargene | 49/501 |
| 3,822,925 | A | * | 7/1974 | Osroff | 312/242 |
| 3,834,782 | A | | 9/1974 | Pampinella | |
| 3,869,752 | A | | 3/1975 | Klay | 16/234 |
| 3,906,670 | A | | 9/1975 | Burton | |
| 3,962,749 | A | | 6/1976 | Abolins | 16/382 |
| 4,165,852 | A | | 8/1979 | Chervenak | |
| 4,377,314 | A | | 3/1983 | Gevers | 312/297 |
| 4,489,459 | A | | 12/1984 | Kempel | 16/248 |
| 4,699,437 | A | | 10/1987 | Genereaux | |
| 4,721,212 | A | | 1/1988 | Lowe | |
| 5,349,909 | A | * | 9/1994 | Smit et al. | 108/107 |
| 5,505,317 | A | | 4/1996 | Rulis et al. | |
| 5,560,112 | A | | 10/1996 | Stein et al. | |
| 5,820,238 | A | | 10/1998 | Lambright | 312/291 |
| 5,984,441 | A | | 11/1999 | Stokhuijzen | |
| 6,457,278 | B1 | | 10/2002 | Fleming | |
| 6,616,253 | B1 | * | 9/2003 | Greaux | 312/248 |
| 6,647,664 | B1 | | 11/2003 | Kochan, Sr. | |
| 6,712,228 | B2 | * | 3/2004 | Lowe | 211/119.004 |
| 6,879,483 | B2 | | 4/2005 | Johnson et al. | 312/265.5 |
| 7,938,279 | B2 | * | 5/2011 | Kaplan | 211/119.009 |
| 2003/0070768 | A1 | | 4/2003 | Lewis et al. | 160/92 |
| 2007/0158957 | A1 | | 7/2007 | Kramer et al. | |
| 2008/0230500 | A1 | * | 9/2008 | Johnson | 211/119.004 |

* cited by examiner

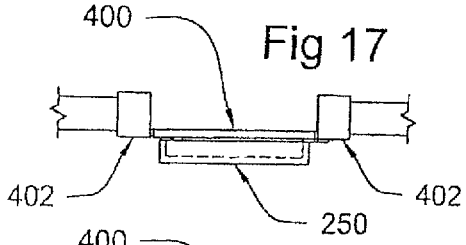
Fig 17
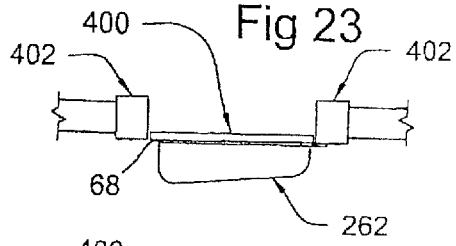
Fig 23
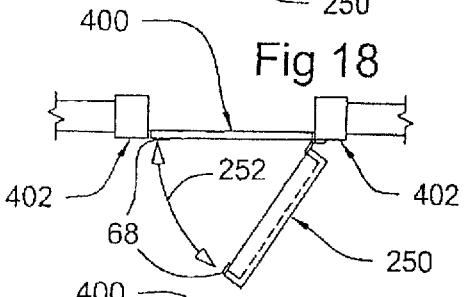
Fig 18
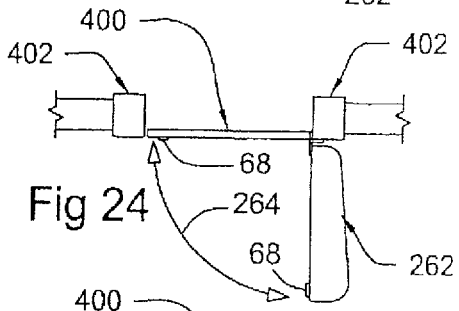
Fig 24
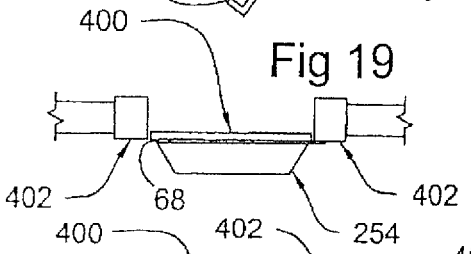
Fig 19
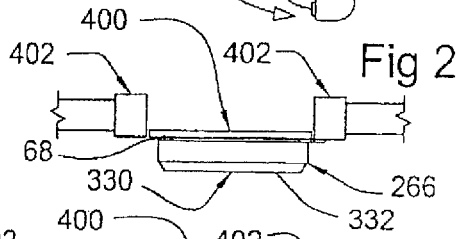
Fig 25
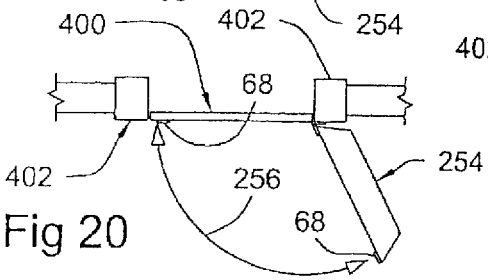
Fig 20
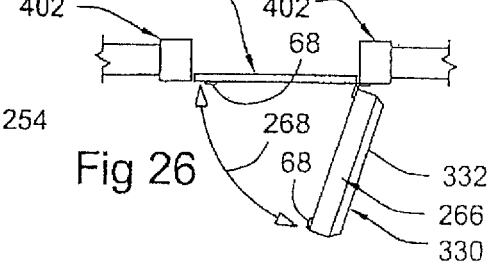
Fig 26
Fig 21
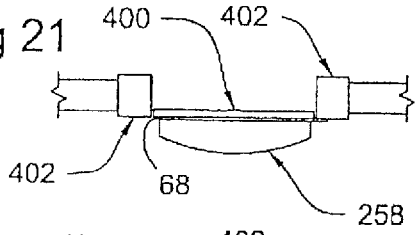
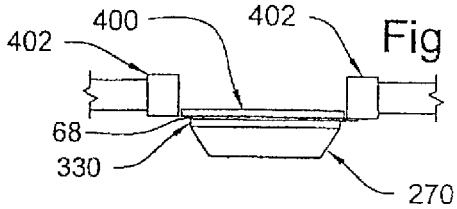
Fig 27
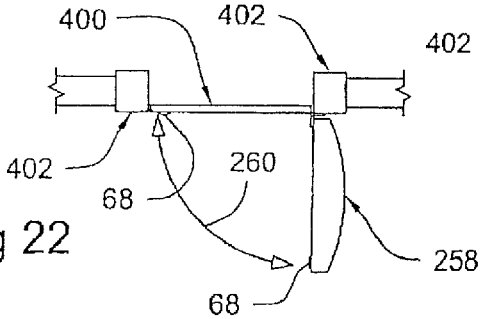
Fig 22
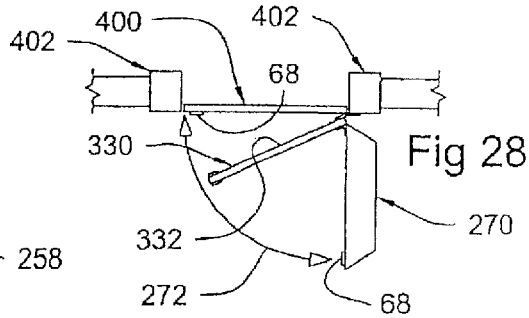
Fig 28

CABINETS AND MIRRORS SELECTIVELY MOUNTED ON HINGES SUPPORTING ROOMDOORS ON DOOR FRAMES, HINGES FOR SUCH MOUNTINGS, AND METHODS FOR SO MOUNTING

CLAIM OF PRIORITY

This is a continuation-in-part of application Ser. No. 12/291,130 filed on Nov. 6, 2008 now U.S. Pat. No. 8,113, 608, now pending, which claims the benefit of Provisional Application No. 61/065,572 filed on Feb. 13, 2008.

FIELD OF THE INVENTION

Articles such as cabinets and mirrors that are supported by the same hinges that support another article such as a door opening to or from a room. In the preferred embodiment, the articles are cabinets can move relative to a door by swinging on the hinges that also support the door or another type of hinged article, so that the cabinets are either closed by the door or other article, or are open to some extent relative to the door or other article. Mirrors are either similarly mounted, or mounted as part of such a hinged cabinet. According to the invention, articles such as a cabinet and a door, or a cabinet and a mirror, or two cabinets, or two mirrors, are mounted on hinges which in turn are supported on a wall or a frame receiving one of the two or more hinged articles.

BACKGROUND OF THE INVENTION

There are numerous cabinets or similar articles that are supported by hinges of various types in the prior art. Examples are shown in the following U.S. patents:

U.S. Pat. No. 6,457,278—Fleming. Issued Oct. 1, 2002, entitled, "Pivotal Doorway Furnishing."

U.S. Pat. No. 3,834,782—Pampinella. Issued Sep. 10, 1974, entitled, "Toilet Article Container."

U.S. Pat. No. 2,907,617—Worrall. Issued Oct. 6, 1959, entitled, "Storage Equipment and the Like."

Des. 152,384—Weaver. Issued Jan. 11, 1949, entitled, "Record Cabinet."

U.S. Pat. No. 767,232—McClung. Issued Aug. 9, 1904, entitled, "Window Refrigerator."

U.S. Pat. No. 6,647,664—Kochan, Sr. Issued Nov. 18, 2003, entitled, "Hanger for a Housing."

U.S. Pat. No. 5,984,441—Stokhuijzen. Issued Nov. 16, 1999, entitled, "Modular Storage and Transportation System of Tools and Materials."

U.S. Pat. No. 4,699,437—Genereaux. Issued Oct. 13, 1987, entitled, "Apparatus for Storing Objects."

None of those patents disclose a cabinet or any other type of container, housing, or apparatus, which is hinged to the same hinges that support a door on a door frame, so that the cabinet or other device is pivotable relative to the door, and can be positioned relative to the door so that the cabinet or other device is closed by the door in one position relative to the door, and is pivotally movable relative to the door to provide access into the cabinet or other device. Nor do they show any such devices mounted on hinges that are mounted on a wall.

BRIEF SUMMARY OF THE INVENTION

A cabinet or other similar device, hereinafter referred to as a cabinet, has hinge sections that are supported on the hinges of a door hung in a doorway. The cabinet has one pivotal position relative to the doorway door wherein access to the interior of the cabinet is provided, and has another pivotal position relative to said door wherein access to the interior of the cabinet wherein access to the interior of the cabinet is closed. The cabinet hinge sections may be that of a double hinge where a first part is hinged to a second part by a single hinge pin, and the second part is hinged to a third part which, in turn, is hinged via a double hinge pin to a part of the original door hinge. This multi-sectioned cabinet hinge permits the cabinet to be pivotally moved about the axis of the double hinge pin relative to the door that is still hinged to the door frame, and at any point may also be pivotally moved about the single hinge pin, permitting the cabinet to be moved through an arc that is about 135° from the cabinet's closed position in which the door also covers the open side of the cabinet, making the items in the cabinet on the cabinet shelves more readily available.

There may be a single cabinet that is pivotally moved to a position where the door has a surface that engages the single cabinet and blocks access to the cabinet interior. The cabinet may have sides that are beveled so that the back is wider than the front, with the front preferably being positioned so that the beveling is at equal angles. This permits the cabinet to be moved to and beyond its 90° fully open position when the sides are not beveled, which is only about 90° from the plane of the door surface 430, the fully open position being some 20° to 30° or more greater than the 90° maximum when the cabinet is shaped as a rectangular box having equal dimensions for the closed back side and the open front side. There may be two cabinets hinged to be immediately adjacent to each other with the door side adjacent the cabinets still being the cover for the open cabinet front when the cabinet is closed against that door side. Separate cabinets may be positioned on the opposite sides of a door, providing cabinet storage space to two rooms which have the door as a common access between them. Of course, since the door is hinged on only one vertical portion of the door frame, the positions of the cabinet hinge portions relative to the other door side will be reversed.

One of the features of the invention is a set of hinge parts for at least two door hinge pins has only two sections, one of which is secured to the side of the cabinet, and the other side is secured to the door frame. A modification of this feature is the double hinged hinges described above. In all instances, there is a common feature of either type of hinge construction, namely that the hinge sections that are secured to a cabinet side are adjustably mounted on the cabinet and have connections, either directly or indirectly through the middle hinge section of the two hinge arrangement, to the hinge pins of the door, so that the cabinet is pivotally supported by the fixed hinge parts serving the door, including the hinge pins. More particularly, the hinge pins each have the usual part that extends through openings in both sections of the door hinges and has another part that is above that usual part, or is below that usual part, separated by a circumferentially enlarged pin head, so that the pin head rests on top of the stationary parts of the door hinges of all the door hinges. At times, it is desirable for only the top cabinet hinge part to be in supporting engagement with the head of the double hinge pin, and the lower cabinet hinge having its hinge part positioned underneath the stationary parts of the door hinges. In this arrangement, the cabinet hinge parts connection to the hinge pins of the door are arranged so that the cabinet hinge lower surfaces are not supported against the pin heads, but are still rotationally guided by the door pins, When it is desirable to easily remove the cabinet from the door without pulling out any hinge pin, all of the cabinet hinge sections that fit around the cabinet hinge pin must fit on the upper end of that pin and be supported by the pin head that separates the upper and lower parts of the hinge pin, thus allowing the cabinet to be removed and replaced without having to take any of the door hinges apart.

Another feature is the arrangement of the shelving within the cabinet to house some relatively unusual items, such as rolls of wrapping paper and accessories for wrapping packages, as well as the tools needed. A cabinet can be provided with a fold-down work space, which may be used for study, reading, sewing, working on arts and crafts, drafting, ironing clothes, or whatever such a work space is needed. Since the work space folds up to be just inside the cabinet, it also acts as a cover. The exterior of the cabinet back side may have a mirror installed on it. It may be a long length mirror for ladies' or gentlemen's dressing, or a shorter mirror which can be easily seen for ladies brushing their hair and using cosmetics. Such mirrors would be available at all times when the cabinet is closed. The invention also includes similar mirrors that go with the cabinet when the mirrors are mounted on a wall and the cabinet is mounted on a hinged frame also mounted on the wall. Depending upon the available room along a wall, and the desires of the person who will be using the room, the hinged frame may be alongside one vertical edge of a mirror mounted on the wall, or may itself be mounted on that hinged frame using hinges that are a part of the invention, so that the mirror is also movable in the manner of a door, as is the cabinet, mounted on hinges secured to that same frame or on an adjacent hinged frame on which the cabinet is mounted on hinges secured to that adjacent hinged frame.

Still another feature of at least one of the cabinets of the invention is that the outer wall of the cabinet, sometimes referred to as its back side, is curvilinear about a substantially vertical axis so that the outer wall of the cabinet forms a vertically extending arc of a cylinder whose axis is remote from the arcuate-sectioned cabinet, with the shelves in the cabinet being similar to arcuate slices of a shelf having a cylindrical arcuate surface that is engaged with the inner surface of the cabinet outer wall. It may also be curvilinear about different axes to vary the amount of curvature in various parts of it.

It is also a feature of the invention to have a mirror, preferably a mirror of sufficient length to use when dressing, that is either a part of the cabinet, located on the outside of the cabinet, or also separately hinged, along with the cabinet and the door, so that it can also function as a closure for some or all of the storage areas within the cabinet, and can be swung on the hinges to provide access to such storage areas, yet when it is desired to use the mirror with the cabinet being positioned well arcuately away from the door which is also mounted on the same set of hinges, by just closing the mirror to close the cabinet storage areas.

BRIEF DESCRIPTION OF THE SEVERAL FIGURES OF THE DRAWING

Figure 1:
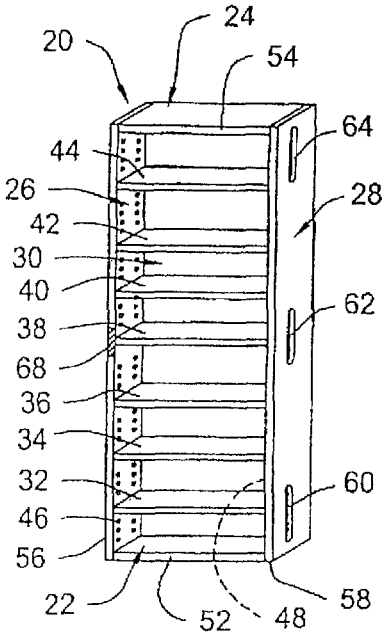
FIG. 1 is a perspective view of a cabinet embodying the invention, before the hinge parts connecting it to the hinges of a door are installed on it.
Figure 2:
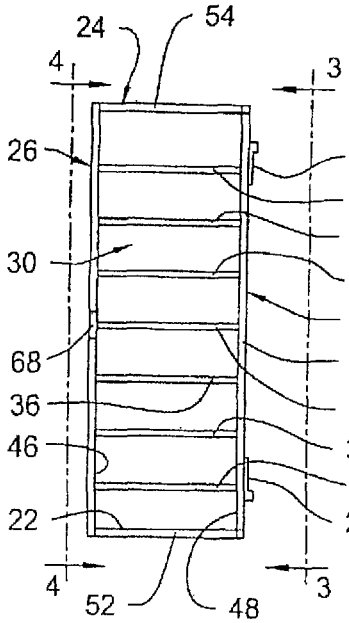
FIG. 2 is a front elevation view of the cabinet of FIG. 1, showing the hinge parts connecting it to the hinges of a door are installed on the cabinet.
Figure 3:
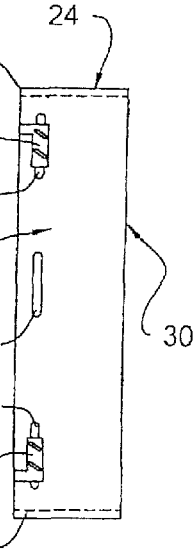
FIG. 3 is a side elevation view of one side of the cabinet of FIGS. 1 and 2, taken in the direction of arrows 3-3 of FIG. 2, on which the hinge parts connecting it to the hinges of a door are installed on the cabinet.
Figure 4:
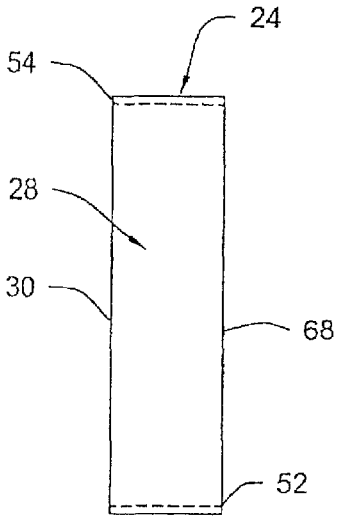
FIG. 4 is a side elevation view of the other side of the cabinets of FIGS. 1 and 2, taken in the direction of arrows 4-4 of FIG. 2.
Figure 5:
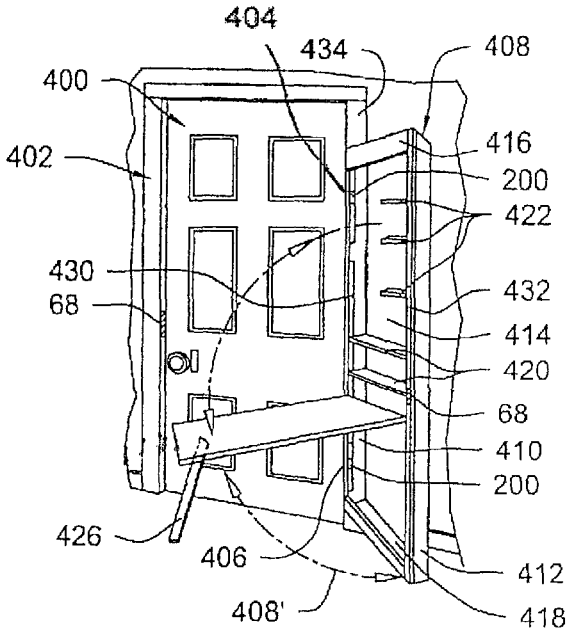

FIG. 5 is a perspective view of a typical door that provides access between two rooms, the door being mounted on hinges pivotally attaching the door to its door frame, including at least two of the hinges on which a cabinet such as that shown in FIGS. 1-4 can also be mounted. A modified cabinet embodying the invention is installed on the door, and is shown opened. Some of this cabinet's versatility is shown. (Re new FIG. 5, in more details) By example, it has a workplace that is folded out to work on its surface, and folded in to cover a part of the cabinet storage area. It also shows the vertical sides of the modified cabinet being beveled inwardly as the front edges of those sides extend further from the cabinet back side, rendering the front edges of the two cabinet vertical sides to be closer to each other than are the back edges of those same cabinet vertical sides, allowing the bevel-sided cabinet to be opened greater than 90°.

FIGS. 6 and 8-10 are somewhat simplified illustrations showing one of the shelves connected to the two sides of the cabinet when the cabinet has a curvilinear back side as later shown in FIGS. 11,12 and 13.

Figure 6:
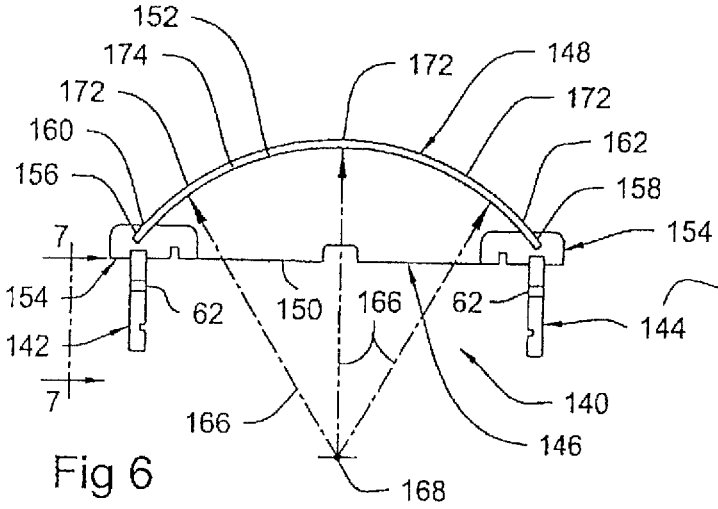
Figure 12:
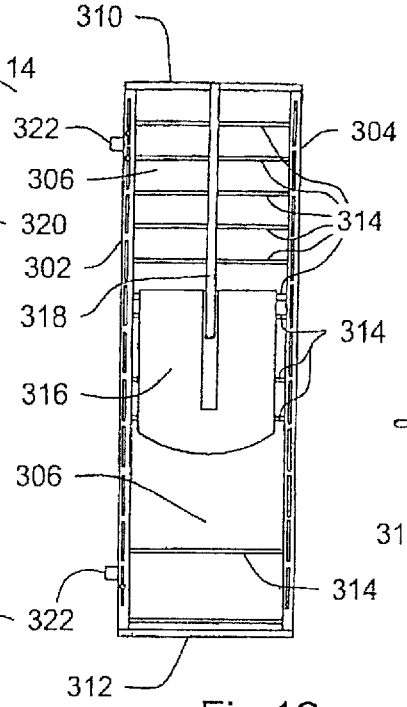

FIG. 6 is therefore a cross-section view taken in the direction of arrows 6-6 of FIG. 12. The curvilinear back side of the cabinet is formed on an arc of a circle and therefore has a constant radius.

Figure 7:
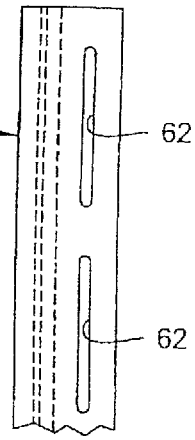

FIG. 7 is an elevation view of one of the sides of a cabinet taken in the direction of arrows 7-7 of FIG. 6, with parts broken away.

Figure 8:
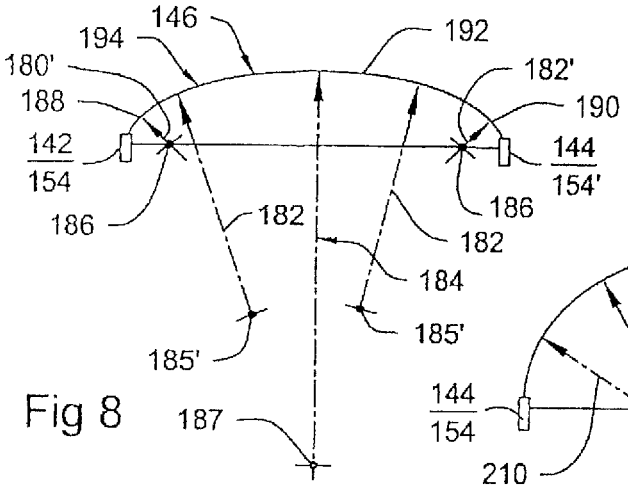

FIG. 8 is similar to FIG. 6, showing the curvilinear cabinet back side formed on either side on an arc having a short radius, with the portions connecting these side arcs being formed on an arc having a much longer radius, resulting in a curved back and the shelf shown being made using such different arcs.

Figure 9:
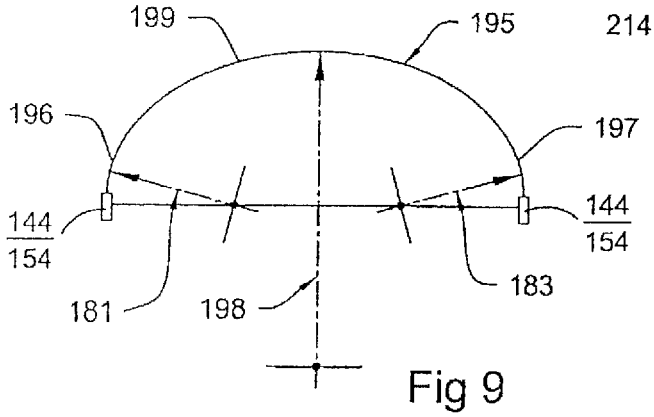

FIG. 9 is similar to FIG. 8, but with the small radius arcs having a somewhat longer radius, and the larger radius arc having a radius that is smaller than the radius of the larger arc of FIG. 8. The effect is the provision of a larger shelf area than the configurations shown in FIGS. 6 and 8.

Figure 10:
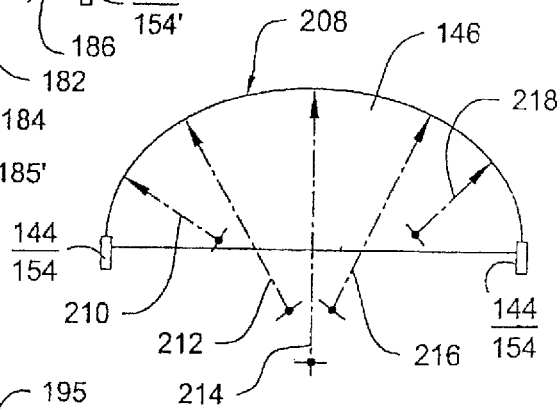

FIG. 10 is similar to FIGS. 8 and 9, but uses the part of the curvilinear back side nearest the cabinet sides formed on an arc having a short radius, then the next two parts of the back sidejoining with those having a somewhat longer radius, and the center part of the curvilinear back side being formed on a still longer radius, thus providing even more shelf area than that provided by the view shown in FIG. 9.

Figure 11:
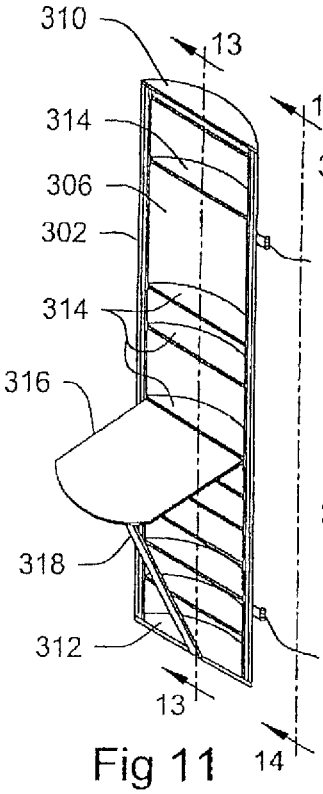

FIG. 11 shows in perspective a simplified form a cabinet that is a modified version of the cabinet of FIGS. 1-4, by making the back side of the cabinet curvilinear, providing a smoother appearance by eliminating the sharp corners where the cabinet sides are joined with the cabinet back side, and also capable of providing somewhat larger shelf areas. This cabinet has the back side curvingly formed as shown in FIG. 6, but it may instead be curvingly formed as shown by any of the FIGS. 8-10. It shows the foldable work surface, such as seen in FIG. 5, opened and in place to work on.

FIG. 12 is a frontal elevation view of the cabinet of FIG. 11, with the work surface in its stored position.

Figure 13:
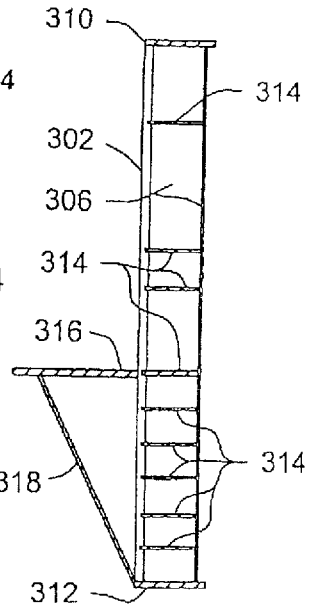

FIG. 13 a cross-section view of the cabinet as shown in FIG. 12, taken in the direction of arrows 13-13 of that figure, with the foldable work surface in the open position shown in FIG. 11.

Figure 14:
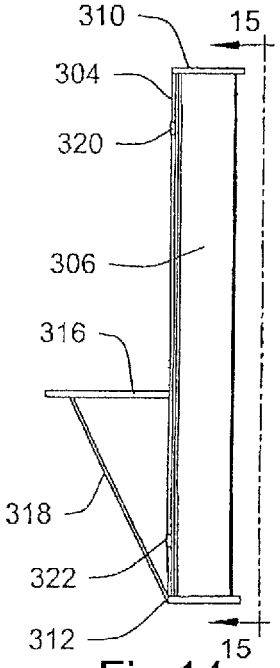

FIG. 14 is a side elevation view of the cabinet of FIGS. 11-13, taken in the direction of arrows 14-14 of FIG. 12, with the foldable work surface in the open position shown in FIG. 11.

Figure 15:
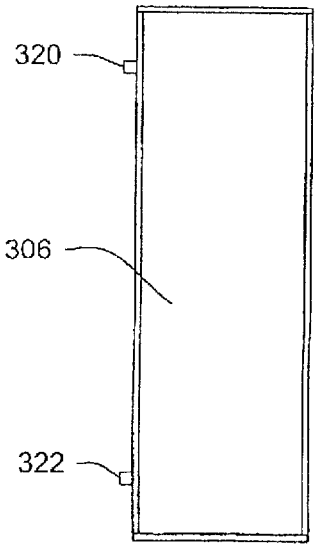

FIG. 15 is a rear view of the cabinet of FIGS. 11-14, taken in the direction of arrows 15-15 of FIG. 14.

Figure 16:
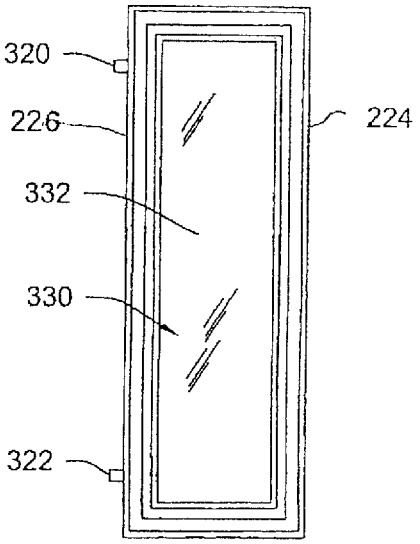

FIG. 16 shows a mirror that is attached to the back side of the cabinet shown in FIG. 15, so that it may be used to be moved to a desirable angular position by moving the cabinet in the direction shown in the illustration seen in FIG. 26.

FIGS. 17 through 28 show, in much simplified form, the closed and open positions of a cabinet having various back side treatments, the cabinet being hinged to the door frame that also has the door hinged thereto using just one hinge part that is secured to the door frame to support both the cabinet and the door, and as shown in one instance, to also support a mirror. All of the views are in the direction as if the viewer is above the cabinet and is looking down on the cabinet installation in relation to the wall, door frame, and door on or relative to the structure on which the cabinet is pivotally supported.

FIG. 17 specifically shows the cabinet of FIGS. 1-4 in its closed position relative to the door and the door frame.

FIG. 18 shows the cabinet of FIG. 17 in an arcuate opening position, but not opened to its maximum extent relative to the door and the door frame.

FIG. 19 shows the cabinet of FIG. 5, which is the beveled back-side cabinet, in its closed position relative to the door and the door frame.

FIG. 20 shows the cabinet of FIG. 19 in its maximum arcuate opening position relative to the door and the door frame.

FIG. 21 shows the cabinet of FIG. 8 in its closed position relative to the door and the door frame.

FIG. 22 shows the cabinet of FIG. 21 (and, except for the specific cabinet back side curvature, of the cabinet of FIG. 9 in its maximum open position relative to the door and the door frame. This position is much like the maximum open position of the cabinet of FIGS. 17 and 18.

FIG. 23 shows the cabinet of FIG. 10 in its closed position relative to the door and the door frame.

FIG. 24 shows the cabinet of FIG. 23 in its maximum arcuate opening position relative to the door and the door frame.

FIG. 25 shows the cabinet of FIG. 116 in its closed position relative to the door and the door frame. The mirror is available for viewing as needed.

FIG. 26 shows the cabinet of FIG. 25 near its maximum arcuate opening position relative to the door and the door frame. The mirror is still available for viewing as needed, while the viewer is standing to the right of the cabinet.

FIG. 27 shows the cabinet of FIGS. 5 and 19 as it is pivotally mounted relative to the door and the door frame, with a mirror like that seen in FIG. 16 being separately mounted for pivotal movements relative to the door, its door frame. The mirror is positioned between the door and the cabinet with its mirror face being adjacent to the door surface 430. The cabinet is shown in its closed position relative to the door and the door frame, and the mirror also being in its closed position to the door and the door frame.

FIG. 28 shows the cabinet of FIG. 27 as it is pivotally mounted relative to the door and the door frame, with the mirror like that seen in FIG. 16 being separately mounted for pivotal movements relative to the door, its door frame, and the cabinet. The cabinet is shown as having been arcuately moved near but not to its maximum arcuate opening position relative to the door and the door frame, and the mirror being arcuately moved to some extent relative to the door and the door frame, but not to its full extent. Such full extent could only be attained with the cabinet having also moved to its full extent. The mirror may be moved concurrently with the cabinet when the mover only wants to use the mirror or access the contents of the cabinet. Any of the alternatives mentioned above with regard to FIG. 27 may be used as desired, so that the mirror is as visually accessible as the user desires it to be.

Figure 29:
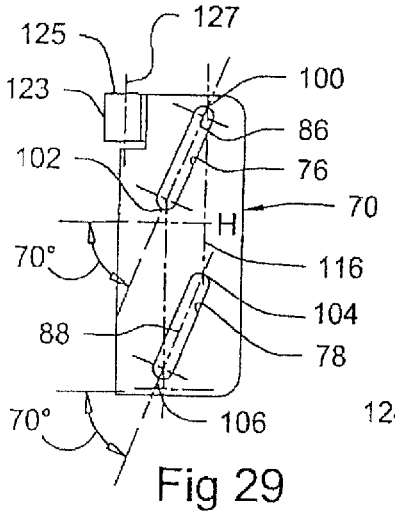

FIG. 29 is an elevation view of the upper one of the hinge parts that are secured to the cabinet of FIGS. 1-4, as well as other cabinets shown in FIGS. 5, 11 through 16, and the cabinets shown in FIGS. 17-27. It can also be used with the mirror of FIGS. 27 and 28. However, the hinges of FIG. 31-33 or 37-38 may be used in some of the FIGURES. to better advantage. The hinge of which this hinge part is a part is modified relative to the standard hinges used only to support a door for opening and closing pivotal movements.

Figure 30:
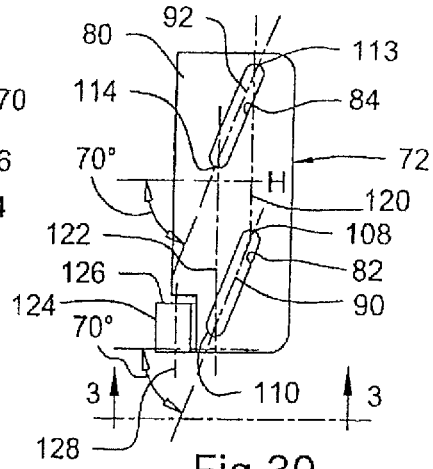

FIG. 30 is an elevation view of the lower one of the hinge parts that are secured to the cabinet of FIGS. 1-4, as well as other cabinets shown in FIGS. 5, 11 through 16, and the cabinets shown in FIGS. 17-27. It can also be used with the mirror of FIGS. 27 and 28. However, the hinges of FIG. 31-33 or 37-38 may be used in some of the FIGURES. to better advantage. The hinge of which this hinge part is a part is modified relative to the standard hinges used only to support a door for opening and closing pivotal movements.

Figure 31:
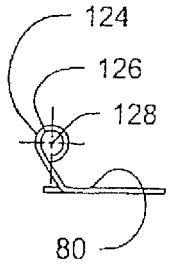

FIG. 31 is an end view of the hinge part of FIG. 29, taken in the direction of arrows 31-31 of that FIGURE.

Figure 32:
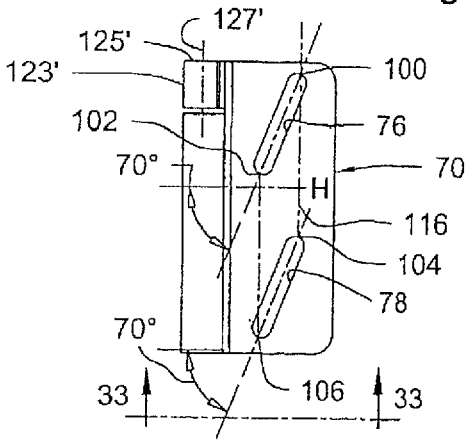

FIG. 32 is an elevation view of a modified hinge part very similar to that of FIG. 29, but constructed to be used with the cabinet side when that cabinet side is connected to the cabinet back side as shown in FIG. 6, so that the extra bends in the hinge part receive a part of the cabinet side.

Figure 33:
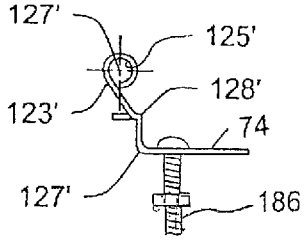

FIG. 33 is an end view of the hinge part 32, clearly showing the extra bends in it to accommodate the construction of the cabinet side to which the hinge part is to be attached.

Figure 34:
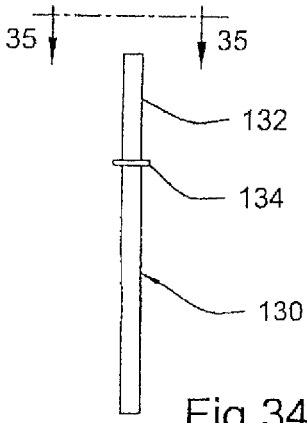

FIG. 34 is an elevation view of the modified hinge pin that is needed when a cabinet, or a mirror, or a cabinet and a mirror, are to be pivotally mounted to a hinge part that is secured to the door frame.

Figure 35:
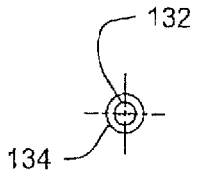

FIG. 35 is an end view of the pin of FIG. 34, taken in the direction of arrows 35-35 of that figure.

Figure 36:
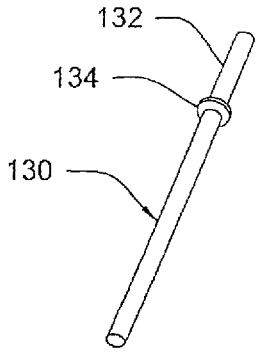

FIG. 36 is a perspective view of the modified hinge pin shown in FIG. 34.

Figure 37:
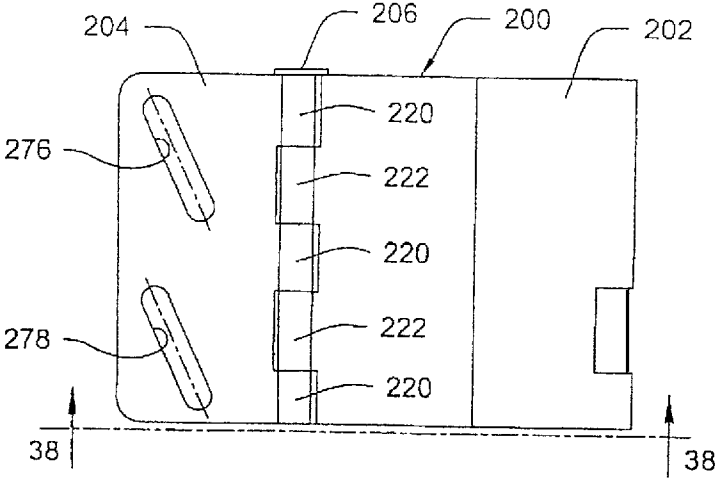

FIG. 37 is a plan view of a further modified hinge showing parts that are secured to a cabinet or a mirror to cooperate with hinge parts secured to a door frame for pivotally mounting the cabinet or the mirror on the same hinge parts secured to the door frame that also pivotally support the door and one, or two, of other devices such as a cabinet and a mirror, on the door frame.

Figure 38:
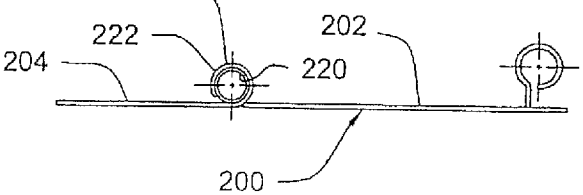

FIG. 38 is an end view of the hinge parts 37, taken in the direction of arrows 38-38 of that FIGURE.

Figure 39B:
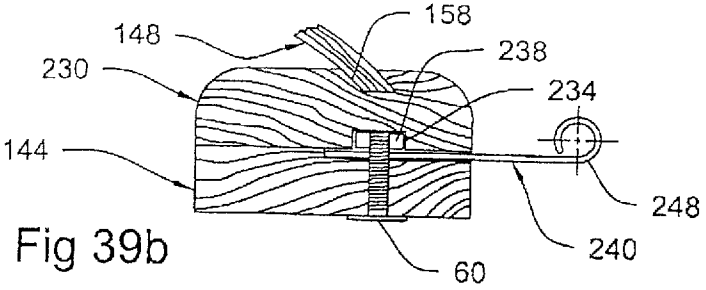
Figure 39A:
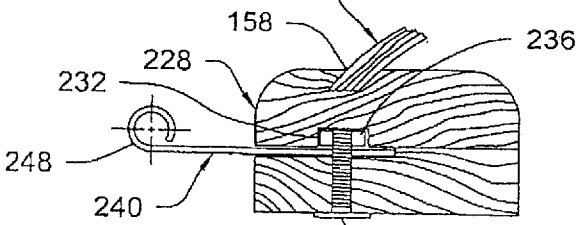

FIGS. 39*a* and 39*b* shows preferred way to attach the curvilinear back to the cabinet sides, and to attach a hinge part to the cabinet that will receive a hinge pin in a cylindrical section of that hinge part. The wood parts of the cabinet are shown in section. The view in FIG. 39*a* is a cross-section view taken in the direction of arrows 39*a*-39*a* of FIG. 11. FIG. 39*b* is a cross-section view taken in the direction of arrows 39*b*39*b* of FIG. 12. They are similar to the right and the left portions of the view shown in FIG. 6 of a cabinet such as those shown in FIGS. 11-15.

Figure 40:
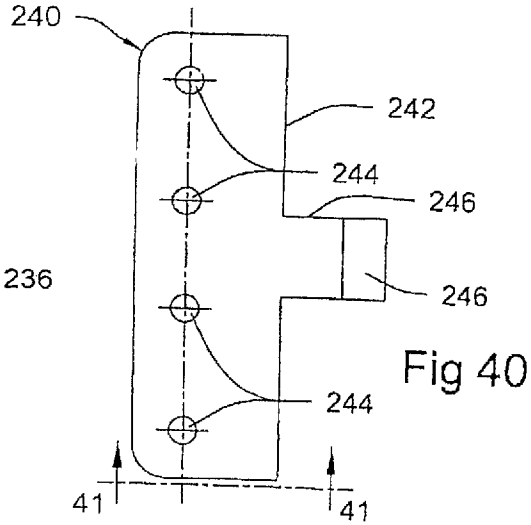

FIG. 40 is a plan view of the hinge part used in FIG. 39.

Figure 41:
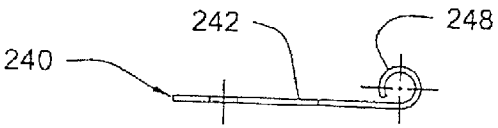

FIG. 41 is an end view of the hinge part shown in FIG. 40, taken in the direction of arrows 41-41 of that FIGURE.

Figure 42:
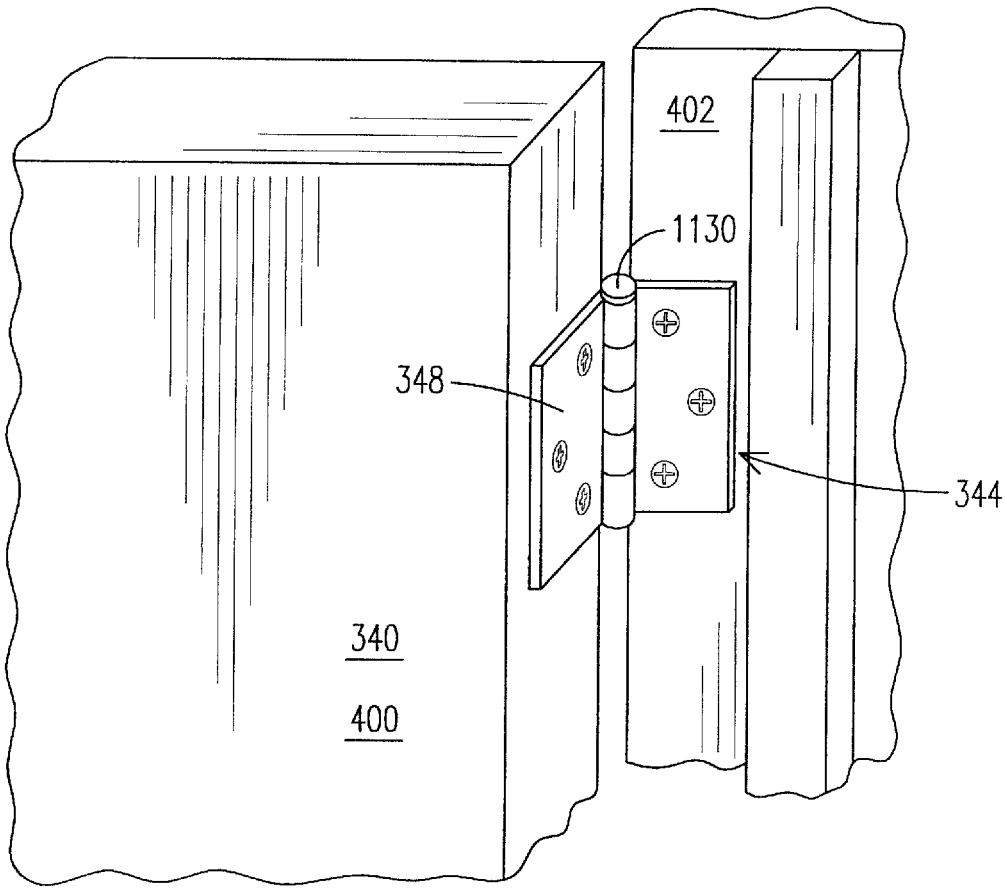

FIG. 42 is a perspective view of a door, door frame and hinge set.

Figure 43:
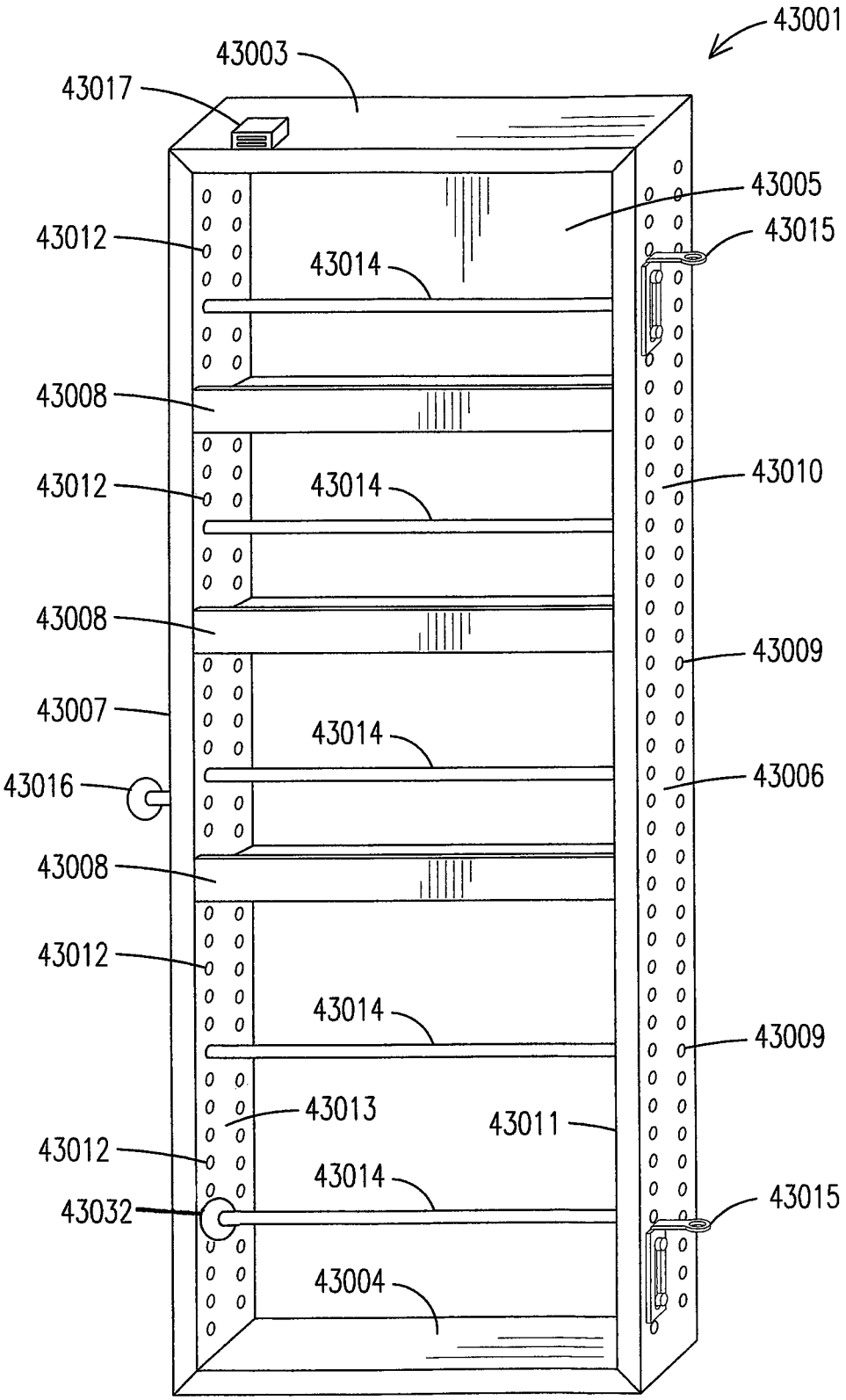

FIG. 43 is a perspective view of the inside of a cabinet of the present invention.

Figure 44:
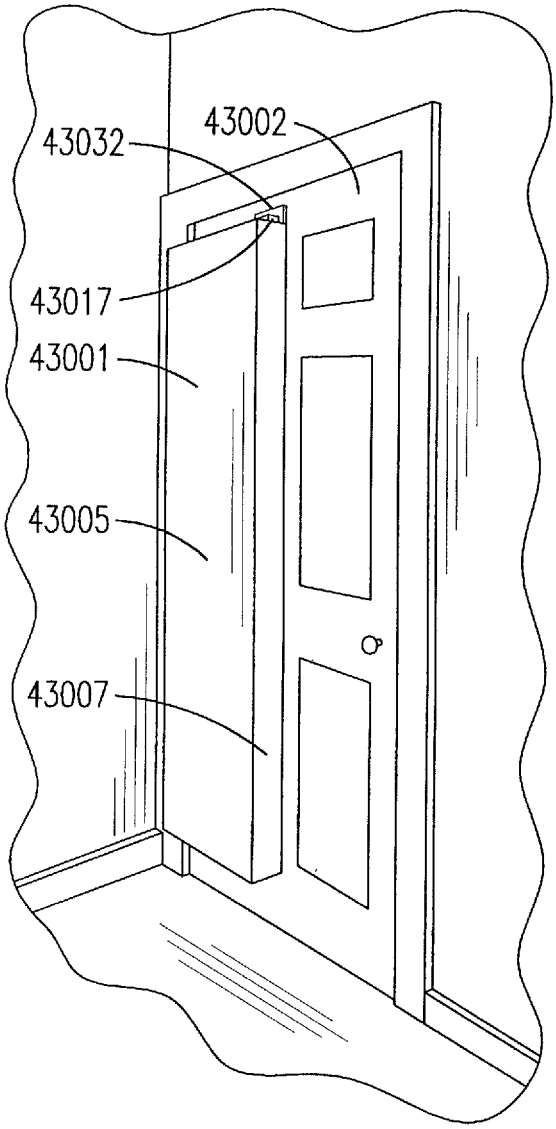

FIG. 44 is a perspective view of a cabinet of the present invention installed on a door.

Figure 45:
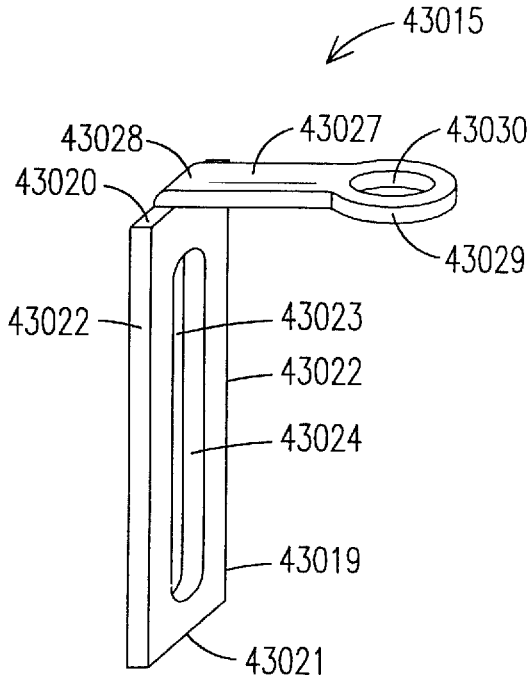

FIG. 45 is a perspective view of a universal hinge hanging bracket of the present invention.

Figure 46:
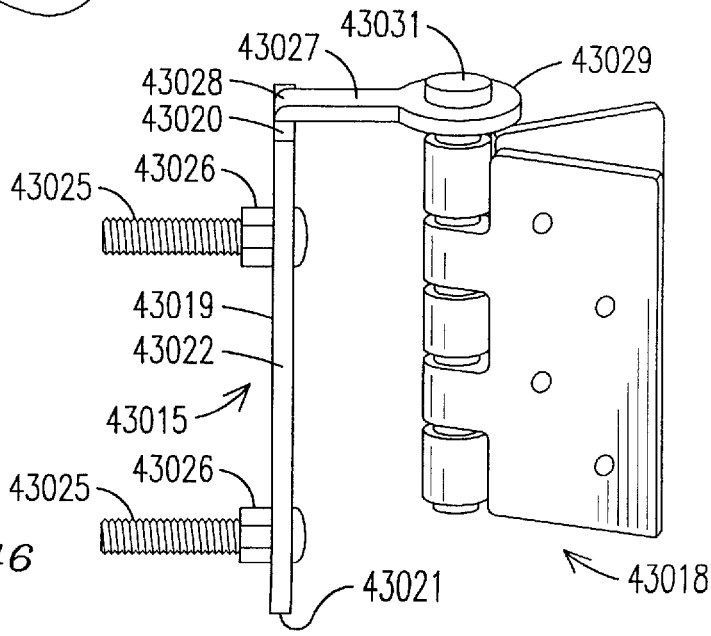

FIG. 46 is a side view of a universal hinge hanging bracket of the present invention installed on a conventional door hinge.

DETAILED DESCRIPTION OF THE INVENTION

The cabinet 20 shown in FIGS. 1-4 has a bottom 22, a top 24, a first side 26, a second side 28, and a third side 30, which is the back of the cabinet. T has a series of shelves 32, 34,36,36,38,40,42 and 44 that are adjustably mounted to the inner surface 46 of side 26 and the inner surface 48 of side 28. It is often advantageous to make one or more of the shelves be fixed. Shelf 38 is the fixed shelf in this cabinet 20. Any of several available adjustment arrangements may be used if the shelves are not to be permanently fastened to the cabinet sides. These shelves extend from the back side 30 forward to or at least very near to the cabinet front surfaces that are defined by the front edges 52 of the bottom 22, 54 of the top 24, and 56 and 58, respectively, of the two sides 26 and 28.

One of the sides, depending on the side of the door to which the cabinet is located when installed, so in this showing that side is side 28. It has at least two vertical slots, and preferably three to five such slots 60, 61, 62, 63, and 64. These slots are better shown in FIGS. 1 and 3, with the side 28 having these slots therein. It would be side 26 if the hinges are to be near that other side. Slots 60, 62 and 64 are located slightly inward of the front surface 58 of the side 28. There is a loop and hook fastener 68, made of Velcro™ or the like, with one half of it being mounted on the door at a designated spot, and the other half being mounted on the cabinet at a designated spot so that, when the cabinet is closed against the door, the two parts of the fastener 68 engage, and hold the cabinet in its closed position against the door until such time as the cabinet is forced, against the gripping action of the fastener, to disengage the two parts of the fastener 68. FIG. 3 also illustrates the adjustable ability of fastening those hinge parts to the cabinet to readily fit with the proper height of the door hinges, and also the fore-to-aft adjustment arrangement relative to the availability of the pins of the door hinges.

FIG. 5 shows a door 400 mounted in a door frame 402 by its hinges 404 and 406. A cabinet 408 embodying a part of the invention is pivotally mounted on the door hinges 404 and 406 using hinges 70 and 72 of FIGS. 29-31, or the hinges 200 of FIGS. 37 and 38. FIG. 5 is a perspective view of a typical door 400 that provides access between two rooms, the door being mounted on hinge parts 404 and 406 of hinges 70 and 72, which are shown in FIGS. 29-31. These hinges have parts that are pivotally secured together so that they pivotally attach the door 400 to its door frame 402. The hinges pivotally supporting the door 400 on the door frame 402 may be located at an upper part, a middle part, and a lower part on the door and also secured to the door frame at corresponding points. However, for the purpose of mounting the cabinet 408, or any other cabinet, on the door frame and also on the door via parts of its hinges, only a minimum of two of the hinges are shown in FIGS. 1-4 which are employed to also pivotally mount the cabinet to the door 400 and to the door frame 402 so that it may be pivotally moved in the arc 408' relative to the door and/or relative to the door frame. Cabinet 408 is a modification of the cabinet of FIGS. 1-4 also embodying the invention, and is shown opened relative to the door 400 and to the door frame 402.

The vertical opposite sides 410 and 412 of the modified cabinet are shown as being beveled inwardly, with the respective front edges 430 and 432 of those sides extending further from the cabinet back side than their back edges, rendering the back edges of the two cabinet vertical sides to be closer to each other than are the front edges 430 and 432 of those cabinet vertical sides 410 and 412, allowing the bevelsided cabinet to be opened so that the arc 408' is capable of being becomes substantially greater than 90° before the cabinet back edge of vertical side 410 touches the surface 434 of the door frame 402. Cabinet 408 has sides 410 and 412, aback side 414, a top 416 and a bottom 418. Top 416 and bottom 418 are also beveled in order to meet the beveling of the sides 410 and 412 at the top and bottom parts of the cabinet. Also, the ends of the cabinet,s bottom 418 and top 416 are formed so that they are slightly trapezoidal in shape, rather than rectangular, as shown in FIGS. 1-4. This allows the sides 410 and 412 to be positioned so that their edges connected to the cabinet back 414 are slightly tapered from the front toward the back of the cabinet. This also permits the cabinet to be moved arcuately outwardly well over 90° as shown by arc 408' without requiring the double-hinged hinges shown in FIGS. 12 and 13, and described below. These beveled vertical sides have a less-than-90° relationship to the cabinet back side, on the order of one or two degrees, up to as much as 10° or more, depending on the amount of additional opening beyond about 90° that is desired. Usually, an opening of through the arc 408' of about 120° to 135° is sufficient.

There are some shelves 420 that extend from side 410 to side 412 and back 414. There are other shelves 422 that are of lesser length that shelves 420, and therefore only are attached to side 412 and back 414, leaving a space from the upper shelf 420 to the top 416 open so that taller items may be stored there. Shelves may be provided at any desired vertical spacing, and may extend only from one of the sides 410 and 412 as desired.

Some of this cabinet's versatility is shown. The board 404 may be pivoted downwardly from its stored position, and it has a leg 426 which can be held in a downward position to support the free end 428 of board 404. This board may be used for many different tasks. For example, it may be a general workplace or a desk space. It may also be used as an ironing board, a drafting table, a surface for assembling relatively small items, a space for wrapping packages or boxes, sewing with a portable sewing machine, and many other similar tasks. It is folded out to work on its surface, and is preferably level in relation to the room floor. When not in use, it may be folded upward about 90° so that it covers a part of the cabinet storage area. Just below the lower shelf 420, the board 404 is pivotally attached to the sides 410 and 412 so that it may be pivoted upward into its stored position, the frontto-back widths of shelves 420 and 422 being slightly less than the depth of the cabinet from the front edges of the sides 410 and 412, allowing sufficient space for the board 424 to be stored within the sides 408 and 410. There may be a latch, not shown, securing the board in its stored position. Or, the two parts of a hook and loop fastener may be respectively attached to the bottom of board 404 and to the inner side of the leg 426, so that when the board is folded up, the leg remains in contact with the board. 5

FIGS. 6-10 show some details of the provision of a curvilinear back side to a cabinet 140 described below in relation to FIGS. 11-15, as well as the descriptions of FIGS. 19 through 28.

FIG. 6 shows the two cabinet sides 142 and 144, a shelf 146, and a curvilinear back side 148. The shelf has a planar front surface 150, and a curved back surface 152. The cabinet sides have one of the sides (or both if the cabinet is being made to be connected to hinges to either of the sides, in the manner shown in FIG. 3, for example) provided with slots such as slots 60, 62, and 64 of FIGS. 1-4, for attachment of parts of at least two hinge sets to the cabinet. One of the slots, 60, for example is seen in the cabinet side 144. If it is likely that a cabinet may at some point be hinged with the side 142 having hinges attached thereto, the slots 60, 62 and 64 may also be provided in that side.

In FIG. 7, which is a side view of side 144, two of such slots are shown. At times, there may be four or five or more of such slots per side, depending upon the height of the cabinet and the number of hinges to be used.

In FIG. 6, Each of the two cabinet sides 142 and 144 has a back side mounting bar 154 having one of the two angularly disposed slots 156, 158 that extend into the back side surface of the side 144 so that their open ends 160, 162 are at a precise angle to the vertical larger surfaces forming the inner and outer sides of the cabinet sides 142 and 144. This angle is determined by the angle that the outer side edges of the curvilinear back surface has to have to be inserted into those angularly disposed slots when the curvilinear back side 148 is assembled with the cabinet sides 142 and 144. Those angles of extension depend upon the final desired cross-section shape of the curvilinear back side 148, the flexibility of the material of which that back side is made, and the desired depths of the shelves at their deepest point and at their shallow ends. The curvilinear shape of the installed curvilinear side 148 is finally determined as it is attached permanently to the cabinet sides 144 and 146 via the mounting bars 154 and the shelf curvilinear back side 148. This attachment is accomplished by the application of Carpenter's Glue or its equivalent, and decorative screws 172 that are screwed through the curvilinear shelf back side 148 and into the shelf 146 and the other similar shelves as well as into the top and the bottom of each cabinet.

Shelf 146 has the surface of its edge 164 formed as an arc 174 of a circle that has a radius 166 originating at the circle's center 168. As shown in this instance, the radius 166 of that circle is somewhat longer in length than the length of the chord defined by the the shelf front surface 150; the radius determining the amount of curvature by which the shelf has been curved on its surface 164 in order to give a desirable amount of maximum depth to each shelf at the center of it from each cabinet side, and the depth that decreases with the length of the shelf front surface 150 that is away from the centerline arc 166 until there is no more shelf surface at either end of each shelf. The screws 172 and the mounting bars 154 will hold the cabinet sides 144 and 146 and the back side 148 in position as the adhesive sets. The screws and the adhesive assure the solid structure of the cabinet.

The flexible curvilinear back side need not be curved with a single constant radius. It may be curved with two different radii lengths as shown in FIGS. 8 and 9, and with continually changing radii as shown in FIG. 10. These complete arcs are shown schematically in each of FIGS. 6, 8 and 10 as being connected to the schematically simplified cabinet sides 142 and 144 with the slots receiving the edges of the back side being substantially parallel. That not need be the case, but for some of the curvilinear shapes that is quite feasible. The preferred material is a relatively thin plywood material with a fine finish on at least the outer side thereof, it is to be understood that the curvilinear cabinet back sides can be made of in casting forms using a hard plastic, or fine wood chips mush like particle board, and usually having a fine outer finish. Wood is the preferred material to make the cabinets, but the entire cabinet, or just portions of it, can be made of hard plastic materials.

As shown in FIG. 8, the back side 174 may be curved using two different radii lengths, two such radii 180 and 182 being the shorter radii and one such radius 184 being the much longer radius extending from its circular center 185. The two short radii 180 and 182 are located only at and near the ends of the curvilinear back side 174 and originate at the centers 186 of their respective circles of which their arc parts 188 and 190 are parts. These two arc parts are located at opposite ends of the total arc 194 forming the complete back side's curvilinear shape. Arc part 192, defined by the radius 184 extending from its center 187, takes up about 84% to 94% of the total of the three arcs portions forming the complete back side's curvilinear shape. That complete back side curvilinear shape has the art parts 188 and 190 at the opposite ends of the arc part 192. The two arc parts 188 and 190 each makes up about 2% to 8% of that back side curvilinear shape total arc 194 in this arrangement. The different curvitures of arc are merged over a short distance where they meet to provide a smooth change from the curvature arc part 192 to the curvature arc parts 188 and 190 respectively defined by the two short radii 180 and 182.

In FIG. 9, the arrangement is similar to that in FIG. 8. There are two radii 181 and 183 which are relatively short in relation to the considerably longer radius, yet considerably longer than the short radii 180 and 182 of FIG. 8. Each shorter radius subtends one of the arc parts 196 and 197. The longer radius 198 subtends an arc part 199. In this arrangement each arc part 196 and 197 is about 25% of the total arc 195, and the arc part 199 is about 50% of the total arc 195. It is to be clear to understand that there may be other arc parts covering different percentages of the total arc to obtain the desired shelf shape for storage and therefore the desired cabinet back side curvilinear shape.

As it is shown in FIG. 10, the total curvilinear arc 208 of a cabinet curvilinear back side can be made with the arc curves resulting from progressive radius lengths, much like the edge of a French Curve drawing tool. This is also schematically shown in FIGS. 21-22. In FIG. 10, the radii change from shorter radii to longer radii as the total arc 208 proceeds from one end of the shelf 146 to the center of the minimum arc curvature, and then proceeds from longer radii to shorter radii as the total arc proceeds from the center of the minimum arc curvature to the other end of that shelf. Therefore, the lengths of the illustrated radii 210, 212 and 214, then radii 216 and 218, are only instantaneous specific lengths, resulting in the curvature of the total curvilinear arc 208 continuously changing and therefore the area and shape of the area of each shelf changes in concert with those arc changes, still usually resulting in a greater working area of each shelf as compared to the shelves of FIGS. 1-4, for example. Of course, it the progressive changes of radii should be used with a shelf similar to the shelf in FIG. 8, like the shelf of FIG. 8, the shelf storage area may be less that the storage area of a shelf in FIGS. 11 through 15.

FIG. 11 shows in a simplified perspective a modified form of the cabinet shown in FIGS. 1-4. Cabinet 300 has a first side 302, a second side 304, a curved back 306, a top 310, a bottom 312, and shelves 314. These shelves have arcuate back edges to which the curvilinear back 306 is attached. That back is also attached at its side edges to the sides 302 and 304. Cabinet 300 also has a workplace board 316 which is pivotable from it storage position shown in FIG. 12 and supported by its foldable leg 318. The curvilinear back side 306 is preferably made from a flat panel that is sufficiently flexible to be bent arcuately as shown. There are plywood parts available having a small thickness which can easily so curved or bent. One example is a thin plywood cover for cabinets that are being refaced. It may also be made of a flexible plastic, or be premolded to shape, and the shelves 314 may optionally be intregrated with that promolded back. In FIG. 11, the cabinet is shown as having hinge parts 240 or 340 and 322 on its side 304. The cabinet would then be pivoted outward in a clockwise direction from the door with which is also pivotally attached to a door frame. It would be mounted on the door hinges connected to the door frame, with the door hinges also being on the left side as viewed by an observer. The hinge parts 240 or 320 and 322 may alternatively be on the side 302 instead, and then the cabinet, and the door with which it is pivoted, would open in a counterclockwise arc. This arrangement is shown in FIGS. 12, 15, and in all of the FIGS. 17 through 28.

FIG. 12 is a front elevation view of the cabinet 300 of FIG. 11, showing the workplace 316 folded up against some of the cabinet shelf front edges. In doing so, it helps retain any items stored on those particular shelves. If the leg 318 is pivotally attached to the bottom instead of the underside of the workplace panel, the lower shelves may be notched, as shown in FIG. 6, to receive the leg. In that instance, the workpiece 316 would also have its pivoting inner end 324 equipped with a sliding pivot so that the workpiece would be stored with its pivoting inner end being uppermost.

FIG. 13 shows the cabinet 300 of FIGS. 11 and 12, in cross section, taken in the direction of arrows 13-13 of FIG. 11. Its workplace 316 is folded down from its storage position, shown in FIG. 12, and the workplace leg 318 supports the workplace so that it may be in use for various tasks. Cabinet 300 has several shelves 314, with the lower ones being more closely spaced vertically than are the two upper ones 314 and 316 of those shelves. In this FIGURE, the hinges 320 and 322 are on the left side (as seen by the viewer) of the cabinet. As noted above, the cabinet would be opened from the door by pivotal movements in a counterclockwise direction. The door would be opened in that same arcuate direction.

FIG. 14 is a side elevation view of the cabinet 300 of FIGS. 11,12 and 13, taken in the direction of arrows 14-14 of FIG. 11, with the workplace 316 being folded down from its storage position, and the workplace leg 318 supporting the workplace so that it may be in use for various tasks. In this view, one can see the right side 304 and the curvilinear back side 306, as well as the edges of the top 310 and the bottom 312. Since the hinges 320 and 322 are attached to the side 302 of the cabinet, they are not visible in this view.

FIG. 15 is an elevation view of the curved back side 302 of a cabinet 300, showing the hinges 304 and 306 that have it fitted as the hinges of a door such as door 400 of FIG. 5.

FIG. 16 is an elevation view of a mirror 330 that is either mounted on the back side 30 of the cabinet 20, shown in any of the FIGS. 1-4, or FIGS. 11-15 if any of those cabinets are modified to have a flat back side like those in FIGS. 1-4, so that the mirror 330 is shown as being attached to the back side of the cabinet, so that it may be readily be used at any time that the cabinet is closed or only slightly open. In this arrangement, because the mirror 330 really is a part of the cabinet, it does not need to have separate hinges.

There are alternatives on how to use the mirror 330, as mentioned below in the detailed description of FIGS. 27 and 28. In each of those alternatives, the mirror 330 may be a pivotal element in its own right, and may be mounted with hinges on the hinge parts secured to the door frame 402. The alternative actually used can be left to the ultimate customer. When the mirror 330 is so independently pivoted, the hinges 320 and 322 would be on the right side (as seen by the viewer) if the door also has it hinges on its right side as seen in FIG. 4. With this arrangement, it could be visible without having to pivot the cabinet, and would be located in front of the cabinet with the cabinet and the mirror being pivotally closed.

Alternatively, mirror 330 could be pivotally mounted in between the cabinet and the door surface 430, with its mirrored surface 332 facing the cabinet, and could be seen, and used as a mirror, if the cabinet is pivoted outwardly. In that mounting, if the mirror surface 332 faces the cabinet, then it would be fully accessible only if the cabinet is more fully opened. Of course, in this arrangement it would be mounted with its hinges on its left side as seen in this FIG. 16, and be so mounted relative to the door that the mirror surface 332 would be closed against the door surface 430, and the cabinet would be outside of the mirror 330, as seen in FIGS. 27 and 28.

FIGS. 17 through 28 show, in much simplified and diagrammatic form, the closed and open positions of a cabinet having various back side treatments, and some manners of mounting a dress mirror, or a smaller one if desired, so that it can pivot either independently with or as a part of a cabinet relative to the door, All of the views are in the direction as if the viewer is above the cabinet and is looking down on the cabinet installation in relation to the wall, door frame, and door on or relative to the structure on which the cabinet is pivotally supported. Any statements about left and right sides shall be taken that such views are as they would be seen by an observer looking down on that particular arrangement and standing in front of, or above, the device or devices that are in front of the door front surface 430. Because there are not necessarily cabinets directly disclosed that can be tied to the various shelf and back sides and left and right sides that use the particular shelf shown, there will be given reference numbers to each set of FIGURES which are to represent a cabinet having that particular shelf and back side shown. When those numbered cabinets also can sometimes be tied to a specific cabinet in other FIGURES, that cabinet will be mentioned. The cabinet curvilinear back sides may be made using radii that are considerably shorter than the width of the cabinet to using radii that are as much as twenty times the width of the cabinet. The radii may be used to define the curvature of the curvilinear back side may be in only one size, or two sizes, or three or more sizes, or be continuously changing radii so that the parts of the curvilinear back side subtended by each radius continually changes their amounts of curvature. Examples of the usage of some of these different radii sizes are shown in some of the drawing figures and described as needed.

FIG. 17 specifically shows the cabinet 250 in its closed position relative to the door 400 and the door frame 402. Cabinet 250 is equivalent to cabinet 20 of FIGS. 1-4.

FIG. 18 shows the cabinet 250 having been moved along arc 252 in an arcuately opened position, but not opened to its maximum extent relative to the door 400 and the door frame 402.

FIG. 19 shows the cabinet 254, which is a beveled backside cabinet such as cabinet 400 of FIG. 5, in its closed position relative to the door 400 and the door frame 402.

FIG. 20 shows the cabinet 254 having been moved along arc 256 to its maximum arcuately open position relative to the door 400 and the door frame 402.

FIG. 21 shows a cabinet 258 in its closed position relative to the door 400 and the door frame 402. Cabinet 258 is comparable to cabinet 300 of FIGS. 11-15 and therefore may be such a cabinet.

FIG. 22 shows the cabinet 258 having been moved along arc 260 to its maximum open position relative to the door 400 and the door frame 402. This position is much like the maximum open position of the cabinet 250, of FIGS. 17 and 18, which is shown in FIG. 18 in its maximum open position.

FIG. 23 shows the cabinet 262 in its closed position relative to the door 400 and the door frame 402. Cabinet 262 is similar to a cabinet having the features of FIG. 9.

FIG. 24 shows the cabinet 262 having been moved along arc 264 to a location that is short of its maximum arcuate opening position relative to the door 400 and the door frame 402. Cabinet 262 can be moved further along arc 264 until it reaches its maximum arcuate opening position. Cabinet 262 is similar to a cabinet having the features of FIG. 10.

FIG. 25 shows the cabinet 266 having a mirror 330 secured to its back side, and which may actually be its back side, the cabinet with its fixed mirror being in its closed position relative to the door 400 and the door frame 402. The mirror 330 is available for use as needed in this closed position. It has its mirror face 332 facing away from the cabinet 266.

FIG. 26 shows the cabinet 266 having been moved along arc 268 to the extent that it is near, but not yet at, its maximum arcuate opening position relative to the door and the door frame 402. The mirror 330 is still available for viewing as needed, provided the viewer is standing to the right of the cabinet after the cabinet 266 and mirror 330 have been moved to the position shown.

FIG. 27 shows the cabinet 270 of FIGS. 5 and 19 as it is pivotally mounted relative to the door and the door frame, with a mirror 330, like that seen in FIG. 16, being separately mounted for pivotal movements relative to the door 400 its door frame 402. The mirror 330 is positioned between the door 400 and the cabinet 270, with its mirror face being adjacent to the door surface 430, and it is independently hinged to the door frame 402 just as and to the extent that door 400 and the cabinet 270 are. The cabinet 270 is shown in its closed position relative to the door 400 and the door frame 402, and the mirror 330 also being in its closed position relative to the door 400 and the door frame 402. Cabinet 270 is very similar to the cabinet 408 of FIG. 5 and the cabinet 254 shown in FIG. 19, in that it has beveled sides and top as those cabinets do, and it can, like them, move arcuately through an arc of about 120° to 135° from the position of the door 400 when that door is closed, before it reaches its maximum movement along that arc. That arc is arc 272, shown in FIG. 28.

FIG. 28 shows the cabinet 270 as it has been pivotally moved arcuately along arc 272 relative to the door 400, the door frame 402, and the mirror 330, with the mirror 330 having been separately moved arcuately along arc 272 to a lesser extent relative to the door 400, the door frame 402, and the cabinet 270. That extent is shown as being about half as arcuately far as the cabinet 270 was moved relative to the door 400 and its door frame 402. The cabinet is shown as having been arcuately moved about 90° which is near but not to its maximum arcuate opening position relative to the door and the door frame, either, and so the mirror 330 has been arcuately moved about 40° to 45° relative to the door 400 and the door frame 402, but not to its full extent, which may be about 90° to about 120° along the arc 272. Such full extent could only be attained with the cabinet 270 having also moved to or at least very near its full extent. The mirror 330 may be moved concurrently with the cabinet 330 when the mover only wants to use the mirror or access the contents of the cabinet. Any of the alternatives mentioned above with regard to FIG. 27 may be used as desired, so that the mirror is as visually accessible as the user desires it to be.

Referring now to FIGS. 29-33, these FIGURES show the hinge parts 70 and 72. Part 70 has its main body 74 having slots 76 and 78, and part 72 has its main body 80 having slots 82 and 84. As shown, each of these slots, as viewed in FIGS. 29 and 30, has a respective longitudinal axis 86, 88, 90, and 92 that lie in parallel planes illustrated by those axes. Also, their upper and lower ends have end points 100 and 102 for slot 76,104 and 106 for slot 78,108 and 110 for slot 82, and 112 and 114 for slot 84. The upper end points 100 and 104, and the lower end points 102 and 106, of slots 76 and 78, lie in parallel vertical planes indicated by dashed lines 116 and 118. Similarly, the upper end points 108 and 112 and the lower end points 110 and 114, respectively of slots 82 and 84, also lie in parallel vertical planes 120 and 122. This arrangement makes it possible, together with the slots 60, 62 and 64, to adjust the cabinet hinge parts to properly mate with the hinge parts of the door hinges. Each of the hinge parts 70 and 72 respectively has a cylindrical opening part 123 and 124, formed out of those hinge parts.

As shown in FIG. 31, the cylindrical opening part 124 has been made by striking out an extended portion of the hinge part 72, so that it first extends at an angle of about 50° from the plane of the hinge part 72, and is then curved to form the cylindrical-opening part 124. The cylindrical opening parts 123 and 124 are similarly and respectively formed from the hinge part 70 and hinge part 72. The cylindrical opening parts 123 and 124 respectively have openings 125 and 126 which respectively have axes 127 and 128. Hinge parts 70 and 72 are to be fastened to the cabinet. There are other hinge parts, described in more detail below, that are fastened to the door frame 402 to support the cabinet's hinge parts 70 and 72, and the door-mounted hinge parts schematically shown in FIGS. 17 through 28, to support the door via its hinge parts, and to support the cabinet by its hinge parts 70 and 72. The openings 125 and 126 are axially aligned with similar openings in the hinge parts that support the door on the door frame 402 so that the hinge pins such as that shown in FIGS. 34 through 36 can be inserted. In making this connection all of the cylindrical opening parts of the various hinge parts have the hinge pins extending therethrough in axial alignment. When a door and a cabinet are so mounted, there are at least a first two hinge parts mounted on the door frame, a second at least two of the hinge parts mounted on the door, and a third at least two hinge parts mounted on the cabinet, with the cylindrical opening parts in axial alignment with the hinge parts on the door. This is accomplished by axially staggering the cylindrical opening parts so that one hinge pin can be, and is, inserted in each set of hinges, so that the door and the cabinet are separately, within arcuate limits, mounted on the door frame so that the door and the cabinet may be arcuately moved as a unit as when opening the door to pass through the door opening. When it is desired to open the cabinet but leave the door closed, the cabinet is pulled arcuately about the hinge pins away from the cabinet, the loop and hook fastener being pulled apart. The cabinet can be pivotally so opened as needed, to a maximum arc of about 90° to as much as about 150° or so, depending in part on the particular type of hinges used, and the shape of the exterior sides of the cabinet, as further described.

FIG. 32 is a plan view of the lh of one of the hinges 404, 406 that may be used with the cabinet 408 of FIG. 5, as well as other cabinets having the construction shown in FIG. 6 in which the mounting bars 154 are so made that, in their securement to the cabinet side 144, they extend laterally outward of the plane of the outer surface of the side 144. The half 70 shown in this figure has a flat surface 74 which has slotted openings 76 and 78 through which the bolts 186 shown in FIG. 33 extend. The bolts extend into the stepped area 188 formed on the inner side 190 of the side 144, shown in FIG. 6 in cross section and in FIG. 7. As seen in FIGS. 6 and 7, there is a nut 194 located so that one flat side of it engages the step 196 forming the stepped area and the opposite flat side of that nut engages the mounting bar. These engagements prevent the nut from turning with the bolt 186 when that bolt is tightly threaded into the nut to hold the hinge half 70 firmly on the cabinet. Because the slotted openings 76 and 78 have their linear axes slanted about 70° from the horizontal edge of the hinge parts 70, the hinges can be vertically and horizontally adjusted until the hinge parts are properly positioned. This is the manner in which various hinge parts are connected and attached to the cabinets, the doors, and the mirrors that are shown in various FIGURES, and are in the final installations are pivotally supported by hinge parts that are pivotally attached to other hinge parts secured to the door frame. This described procedure is used with the various hinge parts disclosed herein.

The change in the hinge part 70 of FIG. 32, shown better in FIG. 33, that is important is that the main body 74 of the hinge part has two substantially oppositely bent rightangled bends 127' and 128' in it to move the part of that main body 74 from which the circular section 124' is struck to allow that main body part and the circular section 124' to be located over the outer part of the mounting bar 134 as shown in FIG. 6. This is needed when the construction of the cabinets is as shown in FIG. 6. In some other cabinet constructions, such as those in FIGS. 1-4, there is no need for this double bend arrangement because there are no protuberances such as the mounting bars 154 that may interfere with the location of the hinge part.

FIGS. 34, 35 and 36 show the modified hinge pin 130 in a side elevation view, the modified hinge pin being substituted for the standard hinge pin, which has a head on its upper end much like the head of a typical nail, when any of the hinge arrangements that are shown herein are used. This modified hinge pin 130 has an extension 132 added onto a standard hinge pin that coaxially receives a cylindrical-opening part of the hinge body when the hinge is positioned on the modified pin, and the bottom edge of that cylindrical-opening part rests on that pin head 134 from which that extension 132 extends. If the modified pin has been installed with the hinge pin enlarged section 134 and the extended portion 132 of the pin beyond it is on the bottom of the hinge set, the hinge pin enlarged portion 134 takes no vertical load factor of the cabinet. Even so, the portion of that hinge pin below that enlarged section does guide and locate the entire hinge set, and thus the cabinet, in their desired aligned positions when the cabinet is pivoted away from the door side surface facing the cabinet when the cabinet is closed by that door side surface.

Hinge 200 of FIGS. 37 and 38 is a double hinge. It has one section 202 that is secured to the cabinet in a manner similar to the hinge parts 70 of FIG. 29, or 32. The hinge section 202 is also engaged with the modified hinge pin 13 0 of FIGS. 34-36, another section 204 that is similar to hinge section 70 or 72 of FIG. 29, and in that it has slots 276 and 278 that are similar to slots 76 and 78 of FIG. 29. Sections 202 and 204 are hinged together about a pin 206. Pin 206 is received by cylindrical openings 220 and 222 formed from the sections 202 and 204. The section 202 is connected by the pin that is also received in the hinge part that is attached to the door frame. By use of this type of hinge, the cabinet can be opened for a greater arc of movement, even when it is not tapered as above described.

FIGS. 39*a* and 396 are closely related to the respective right and left portions of the view shown in FIG. 6. They show the preferred manner of attaching a flexible cabinet back side to the sides of the cabinet shown in FIGS. 11 through 15. They also show a hinge part The cabinets 224 of FIGS. 11 and 226 of FIG. 12 each has sides 226 and 228. Side 226 is shown in FIG. 39*a* and side 228 is shown FIG. 39*b*. These sides are very similar to the sides 142 and 144 of FIG. 6, but instead of their width being fore and aft on the cabinet their width extends laterally of the cabinet as shown in FIGS. 11 and 12. Therefore, the slots 62 of the sides 142 144, shown in FIG. 7, are seen as they are shown in FIG. 7, opening outwardly, as do the slots seen in the views of the fronts of the cabinets 224 and 226. The mounting bars 228 and 230, which are similar to the mounting bars 154 of FIG. 6, also have their width extending laterally of the cabinet. Both the cabinet sides 224 and 226, and the mounting bars 228 and 230 extend vertically for the height of the cabinet, less the thicknesses of the respective cabinet tops and bottoms. The angled slots 156 and 158 in the mounting bar 154 are replicated as slots 232 and 234 in FIGS. 39*a* and 39*b*, and are shown receiving one side edges of the curvilinear side, or the other side edge. The unnumbered slots of FIG. 6, shown in the mounting bars 154 as receiving edges of the cabinet sides 142 and 144, are respectively shown as slots 232 and 234 in both of the FIGS. 39*a* and 39*b*. In these two figures, they each respectively receive nuts 236 and 238 when there is to be a hinge section 240 installed on the left side, or the right side, of a cabinet. These hinge sections are shown in FIG. 11 as being on the right side of the cabinet, and in FIG. 12 are shown as being on the left side of the cabinet. As earlier noted, the hinge sections secured to the cabinets are located on one side or the other, depending on the way the cabinet is being supported by the hinge sections and hinge pins when installed. In FIG. 5 as well as in the FIGS. 17 through 28, the cabinet hinge pins are on the left side of the cabinets, as they are shown in FIG. 12.

The hinge section 240 shown in FIGS. 40 and 41 has a main body section 242, which has openings 244 in it through which the bolts 246 extend, and hold the hinge section securely to the cabinet. It has an extension on the end of which is the formed cylindrical opening 248 for receiving a hinge pin therethrough. It is the main body section 242 of the hinge section 240 that is received in the recess formed in the cabinet sides 142 and 144, with a set of bolts 60, here shown as probably being four bolts, because there are four bolt holes 244 in that hinge section, which extend through each of those bolt holes 50 in the cabinet side to which the hinge sections are to be attached, then through each of the bolt holes 244, and then threaded into the nuts 236 in FIGS. 39*a*, and 38 in FIG. 39*b*, and tightened to secure the hinge section in place to the cabinet. The size of the slots 232 and 234 are such that the square or hex-sided nuts cannot be turned as the bolts are turned and screwed tightly in those nuts.

Because some confusion may exist concerning the hinges and their hinge parts, in relation to their connection to the door, the door frame, the several cabinets and the minor, the following terminology has been developed.

There are three types of hinge sets, identified as A, B, and C. There are three parts in each of these hinge sets. They are two hinge sections and a hinge pin. One of these two sections is secured to the door frame, and the other is secured to the door or to the cabinet being hung on the hinges that support the door.

When the door 400 has been previously installed on the door frame 402, it has two or more hinge sets A installed. The hinge parts of each of the hinge sets A that are secured to the door 400 are hinge parts W, and the hinge parts that are secured to the door frame 402 is hinge part X. Hinge parts W and X are connected by the hinge pin P.

In the following identifications, "hp" means "hinge part" and the letter following it identifies a particular hinge part. "P" is the standard hinge pin that would be in the standard hinge set A when there was no cabinet supported by those hinges. "P/' is a longer hinge pin that is used when the hinges are modified to support a cabinet as well as the door. The definitions of the various hinge sets as they are connected to the door and the door frame, or to the cabinet and the door and also on the door frame are set forth below.

There are at least two of each of the originally installed hinge sets, here defined as:

hinge set A=Door-hpW-P-hpX-Door Frame

The at least two hinge sets A are the two or more hinge sets already supporting the door 400 on the door frame 402. They are the ones that were installed when the only item that was contemplated to be supported by hinges was the door. Therefore, the hinge sets A still have the two hinge parts W and X. If the door 400 and the cabinet are being installed together for the first time, the installer would start out with hinge set C. However, if he approaches the installation when the door is supported by the hinge sets A, he will usually begin by substituting the hinge pins Pj for the original hinge pins P.

This action will result in the hinge set B being created. It is only done for temporary purposes. The installer may just skip creation of hinge sets B, and go directly to hinge sets C, defined below.

In order to begin the installation of a cabinet that is to be supported on the same hinges as the door 400, hinge sets A have to be modified. First there has to be a longer length hinge pin. Therefore, Pj must be substituted for the original hinge P. This provides the following hinge set B, of which there are at least two:

hinge set B=Door-hpW-P1-hpX-Door Frame.

The hinge sets that are to support the cabinet on the door frame 402, may be at least two hinge sets. When there are three hinge sets A or B supporting the door 400 on the door frame 402, the cabinet may need only two of the hinge sets B when the cabinet does not extend its vertical height so that it covers three hinge sets for the door 400, or it may be of sufficient height to also require three such hinge sets when there are three hinge sets supporting the door 400 on the door frame 402.

When the installer begins the actual installation of the cabinet, he must change the former hinge sets, whether they be hinge sets A or B, to hinge sets C. Each hinge set C is assembled as follows, using hinge part Y for the beginning part of the hinge set C that is to support, and the hinge part Z, which is substituted for the hinge part W. Hinge set C is assembled as follows:

hinge set Cabinet-hpY-Pj and door-hpZ-Pj and those two hinge parts being connected by P1 to the hpX that is still mounted on the door frame 402.

The different hinge parts Y, Z, and P1 are required in order to allow the cabinet to be supported on the same hinge parts secured to the door frame 402 as is the door 400 relative to the door frame 402, and particularly to permit them to swing sufficiently far away from the door to allow the interior of the cabinet to be accessed when desired.

The above presentation parts have the following relation to the numbered parts in the drawings:

As illustrated in FIG. 42, Hinge set A=Hinge set 344 Door=340, 400 Door Frame=402.

hpW (hinge part W)=348, P=the standard hinge pin 356

P^he elongated hinge pin 1130 hpY=hinge part attached to the cabinet and pivotally mounted on Pj hpZ=hinge part attached to the door and pivotally mounted on PP hpX=hinge part attached by one end of it to the door frame and having P1 received on the other end of it.

In a typical arrangement, there are at least two hinge sets, and often three, that support a door 400 in a door frame 402 before it is decided to add the support of a cabinet to those hinges. These hinge sets are then identified as hinge sets A.

Hinge sets A each have three parts. They are: hinge part W (hpW) is secured to the door frame, the hinge part X (hpX) which is secured to door, and the standard hinge pin P pivotally connecting these hinge parts through their cylindrical ends. Each of the hinge parts W (hpW) has a vertically extending cylindrical end CeW, and each of the hinge parts X (hpX) has a vertically extending cylindrical end CeX. The hinge part W (hpW) is so mounted on the door frame that its vertically extending cylindrical end CeW is underneath the cylindrical end CeX. These cylindrical ends have axes aCeW and aCeX that are in vertical alignment. There is also a standard hinge pin P that extends through both of those cylindrical ends CE, and the axis aP of the standard hinge pin is also in vertical axial alignment with the axes aCeW and aCeX, allowing the door to swing horizontally about the aligned axes of those hinge parts. The hinge part X's cylindrical end CeX is usually located above the cylindrical end CeW of the hinge part W (hpW).

When the cabinet is to be mounted on the same hinges that are already supporting the door, the hinge sets B may be created for temporarily holding the door 400 in place relative to the door frame 402, until hinge sets C can be put together. The hinge part W (hpW) is still used as a part of the Hinge sets B, but the hinge part X (hpX) is replaced by the hinge part Y (hpY), because a different type of fastening of the hinge parts that are attached to the cabinet that have to be connected to the door frame. These hinge parts are known as part Y (hpY). Therefore Hinge Sets B are made up of hinge parts W and Y(hpW and hpY), and a hinge pin. Since hinge parts W remain on the door frame, its Cylindrical end CeW remains in its axially vertical position, and the hinge part hpY is added to to the creation of each of the hinge sets B, with its cylindrical end CeY being located over the cylindrical end CeW, and the hinge pin P is reinserted inserted axially through the aligned cylindrical ends. With this combination of hinge parts, the door 400 still is mounted to be moved horizontally in an arc about the vertical axis with which the cylindrical ends CeW and CeY are also vertically aligned, but it is now ready to receive hinge parts. These hinge sets B operate identically to hinge sets A until the cabinet is to have its hinges also connected with the door frame.

To begin the operation of placing the cabinet in pivotal support with the door frame hinge parts Y, the hinge sets C are created. There are at least two of the hinge sets C. The cabinet's hinge part Z is secured to the cabinet, and, with the hinge pin P removed, has its cylindrical end CeZ placed over the cylindrical end CeY, and in axial alignment with it, The elongated hinge pin Q is then inserted through those three aligned cylinder ends, starting at the top, until its headrests on the top of the cylinder end CeZ. Now, each group of hinge sets comprises the hinge part Z (hpZ), the hinge part Y (hpY), and the hinge part W (hpW), one being secured to the cabinet, and one being secured to the door, and the third one being secured to the door frame and supporting the other two hinge parts.

If the cabinet is at least almost as high as the door's height, it may be pivotally secured to the door frame with two hinge sets C, whether the door itself is pivotally supported by two or three of the hinge sets B, or two of hinge sets B and one of hinge set A. If the cabinet is considerably less high than the door's height, it would usually be supported by two hinge sets C, which would be associated with two of the hinge sets B for the door, with another hinge set, either B or A, being the lowest one of the three hinge sets that support the door only, assuming that the cabinet is to be mounted higher than that lowest hinge set B or A. In this arrangement, since it will be known before that two of the three hinge sets are to be prepared to support the cabinet by first converting the two higher hinge sets A to hinge sets B, and that the lowest hinge set of three hinge sets mounting the door on the door frame will not be involved, it would be necessary, and economically feasible, to leave that lowest hinge set as a hinge set A. Then, when the cabinet is ready to be mounted to also pivot on the door frame, those two hinge sets B are converted to hinge sets C.

When the cabinet is about to be hung while all of the hinge sets supporting the door on the door frame are hinge sets A, the momentary creation of hinge sets B is usually omitted, and the two upper hinge sets A are directly changed into hinge sets C.

When the door is supported on the door frame by only two hinge sets A, then the cabinet must be of such vertical height that it extends upwardly beyond the horizontal location of the upper hinge set A, and downwardly beyond the horizontal location of the lower hinge set A. Then all of the hinge sets A will be converted either to hinge sets B on a short-term basis, and then will be further converted to hinge sets C, or the hinge sets A will be directly converted to hinge sets C when the cabinet with its hinge parts secured to it, and as it is being hung on the hinges secured to the door frame.

A summary of specifically claimed features of the invention, particularly and as are primarily provided in the independent claims filed, is as follows:

One, or both, of the cabinet side panels have a plurality of vertically aligned slots. The cabinet has hinges that are in part modified by providing a longer hinge pin. The modified hinges have the hinge sections thereof attached to one side of the cabinet side panels through the slots formed therein so as to adjust to the vertical location of the door, with the one hinge section having at least two cylindrical ends through which the longer hinge pin can be fitted while the two cylindrical ends are spaced so that they can mate with the standard hinge parts that are mounted on the door frame and can have the cylindrical part of each of the standard hinge parts receiving at least one of the cylindrical parts of the door hinge part affixed to the door frame, with the longer hinge pin being sufficiently long to extend through the cylindrical parts of the hinge parts affixed to the door frame. The cylindrical parts are parts of the modified hinge part secured to the door, so that the cabinet is adapted to be connected to the door frame by the hinges that are so connected to the door frame and the door, to the extent that the cabinet is able to be pivoted about the longer hinge pins relative to the door.

The cabinet has a back panel that is formed in at least one curve about a vertical axis and throughout a horizontal arc of no more than about 180°. The at least one curve is an arc of a circle whose radius is between one (1) time and twenty (20) times as large as the depth of the cabinet from the center of the arc to the front of the cabinet assembly.

The cabinet assembly, in which the first and second side panels each respectively have first and second vertical edges and the curved back panel, has first and second vertically extending outside edges which are respectively secured to the first and second vertical edges of first and second side panel vertical edges.

The cabinet's back panel curve extends outwardly to the lateral distance defined by the cabinet side vertical edges and then extends in a planar manner in parallel from the back panel curve to the cabinet side vertical edges.

The cabinet and a door having a door frame have a plurality of hinge sets which independently support the cabinet and the door on the door frame. Each of the hinge sets has a hinge pin which has an axially extending center. There is a separate first hinge part that has first and second ends, with the first end being firmly attached to the door frame. There is also a separate second hinge part having first and second ends, with the first end thereof being firmly attached to the cabinet. There is also a separate third hinge part having first and second ends, with the first end thereof being connected to the door. Each of the second ends of the separate hinge parts has a cylindrical end receiving the hinge pin for independent pivotal movements about the hinge pin's axially extending center. The hinge sets each allow the door to be moved in door opening and closing directions relative to the door frame without causing coextensive pivotal movements of the cabinet relative to the door. The hinge sets also allow the cabinet to be moved about the hinge pin in opening and closing directions relative to the door by pivotal movements relative to the door and to the door frame, without causing pivotal hinge movements of the door relative to the door frame.

The invention in an additional sense is also an improvement in the above mounting at least two different structures which are each mounted by a plurality of hinge sets on a door frame for pivotal movements relative to the door frame. Each of the hinge sets includes a hinge pin and a hinge part secured to a first one of the at least two different structures. Another one of the hinge parts is secured to the door frame, and the hinge parts are connected together by a hinge pin so that the first one of the at least two different structures can be moved arcuately relative to the door frame. The first structure is a door fitting in the door frame, and the second structure is a cabinet that has a second plurality of hinge parts secured thereto. Each of the second plurality of hinge parts also receives the hinge pin so as to be connected by means of that hinge pin in a pivotal connection that allows the second structure to be arcuately movable independently of the first structure instead of being required to arcuately move with it.

The improvement in mounting the at least two different structures for independent pivotal movements relative to the door frame further comprises a third structure that is a part of the at least two structures. The third structure has a third plurality of hinge parts secured thereto. These hinge parts receive the hinge pin so as to be connected via the hinge pin in pivotal connection in the manner that allows the third structure to also be arcuately movable independently of the first one of the at least two structures and the second one of the at least two structures being required to arcuately move with it.

More specifically, the first structure is a door, the second structure is a cabinet, and the third structure is a mirror, with each of the three structures being independently pivotally movable about the hinge pin through arcuate movements sufficient to permit the independent use of the cabinet and the mirror to at least a limited extent of about 45° of such independent movement relative to the door frame.

The invention is also characterized as a method of mounting a door and a cabinet on a door frame so that they are independently able to be moved to some extent relative to the door frame, with the method comprising these steps: Step (A) provides at least two hinge sets that each pivotally support a door and a cabinet on a door frame in a manner that the door and the cabinet pivot about one common hinge axis, each of the hinge sets having first and second and third parts and a hinge pin. Step (B), provides each of the hinge sets with a longer-than-standard-length hinge pin than the standard length hinge pin that is commonly used when only a door is being attached to a door frame using hinge sets. In step (C), the a first part of each hinge set is secured to the door frame. In step (D) a second part of each hinge set is secured to the door. In step (E), a third part of each hinge set is secured to the cabinet; and, in step (F), the hinge pin is inserted through openings of each of those hinge parts that are adapted to receive the hinge pin therethrough along a common axis. This results in having pivotally mounted the door and the cabinet for separate pivotal movements relative to the door frame about the hinge pin.

That method more particularly also includes the following additional details of certain steps: In step (C), providing the first part of each hinge set with one section for securing it to the door frame, providing another section of the first part with a cylindrically shaped opening for receiving a hinge pin; and securing only the one section of the first part of each hinge set to the door frame; in step (D) providing the second part of each hinge set with one section for securing it to the door, providing another section thereof with a cylindrically shaped opening for receiving a hinge pin, and securing only the one section thereof to the door; in step (E) providing the third part of each hinge set with one section for securing it to the cabinet, providing another section thereof with a cylindrically shaped opening for receiving a hinge pin, and securing only the one section thereof to the cabinet; and in step (F), arranging the cylindrically shaped openings of each of the parts of each hinge set in axial alignment and inserting the hinge pin through each of the cylindrically shaped openings.

With reference to FIGS. 43 and 44, a perspective view of the inside of a cabinet 43001 of the present invention and a perspective view of a cabinet 43001 of the present invention installed on a door 43002, respectively, are illustrated. The cabinet 43001 comprises a top panel 43003, bottom panel 43004, rear panel 43005, interior side panel 43006 and exterior side panel 43007 to create a substantially box shaped cabinet 43001 having an open area for placing shelves 43008 that extend across the cabinet 43001 from the interior side panel 43006 to the exterior side panel 43007. Full apertures 43009 are located on the interior side panel 43006 and extend all the way through from an exterior surface 4310 of the interior side, panel 43006 to an interior surface 43011 of the interior side panel 43006. Partial apertures 43012 are located on an interior surface 43013 of the exterior side panel 43007. The partial apertures 43012 do not extend all of the way through the exterior side panel 43007 to an exterior surface 43013 of the exterior side panel 43007, thereby creating a clean look to the exterior surface 43013 of the exterior side panel 43007, which is visible when the cabinet 43001 is installed on a door 43002, as illustrated in FIG. 44. In contrast, the exterior surface 43010 of the interior side panel 43006, which has full apertures 43009 located thereon, is not visible when the cabinet 43001 is installed on a door 43002. The cabinet 43001 may be installed on any door regardless of whether the door opens to the right or the left by flipping the cabinet 43001 upside down so the interior side panel 43006 faces the side of the door where hinges are installed and the exterior side panel 43007 faces the doorknob. The full apertures 43009 allow a user to install retention rods 43014 across the width of the cabinet 43001 by placing a retention rod 43014 through a full aperture 43009 and into a corresponding partial aperture 43012. The retention rod 43014 may then be locked into place with a securing means 43032, such as a rubber washer that prevents the retention rod 43014 from passing back through the full aperture 43009. The full apertures 43009 also allow a user to adjust the placement of universal hinge hanging brackets 430015 on the interior panel 43006 to accommodate doors having hinges that are installed at various heights. A knob 430016 located on the exterior surface 43014 of the exterior side panel 43007 allows a user to open and close the cabinet 43001 against a door 43002. A magnet 43017 located on the cabinet 43001 keeps the cabinet 43001 in a closed position against the door 43002 by engaging a corresponding that may be installed on the door 43002.

With reference to FIGS. 45 and 46, a perspective view of a universal hinge hanging bracket 43015 of the present invention and a side view of a universal hinge hanging bracket 43015 of the present invention installed on a conventional door hinge 43018, respectively, are illustrated. The universal hinge hanging bracket 43015 comprises a substantially rectangular-shaped plate 43019 having a top 43020, bottom 43021 and sides 43022. At lease one aperture 43023 is located on the substantially rectangular-shaped plate 43019. The at least one aperture 43023 is preferably a slot 43024 to allow the universal hinge hanging bracket 43015 to be adjusted up or down when being installed on a cabinet 43001 of the present invention, as illustrated in FIG. 43, using bolts 43025 and nuts 43026. An arm having 43027 a proximal end 43028 and distal end 43029 extends from the top 43020 of the substantially rectangular-shaped plate 43019. An aperture 43030 is located on the distal end 43029 of the arm 43027. The universal hinge hanging bracket 43015 may be installed on a conventional door hinge 43018 by removing a hinge pin 43031 from a the door hinge 43018 and then placing the hinge pin 43031 through the aperture 43030 located on the distal end 43029 of the arm 43027 and back into the door hinge 43018. The universal hinge hanging bracket 43015 may then be rotated on the hinge 43018, thereby allowing a cabinet to be opened and closed.

Having thus described my invention, I claim:

1. A cabinet that is mountable to hinges having hinge pins used to hang a door hung in a door jam so that said cabinet can be pivoted upon the hinge pins independently of the door, said cabinet comprising:

a top panel, a bottom panel, a rear panel, an interior side panel and an exterior side panel;

a plurality of full apertures located on the interior side panel that extend from an exterior surface of the interior panel to an interior surface of the interior panel;

at least one L-shaped bracket comprising a plate having a top, a bottom, sides and at least one aperture located on the plate;

said at least one L-shaped bracket is adjustably attachable to any single full aperture of the plurality of full apertures via at least one nut and at least one bolt so as to adjust to the vertical location of the location of the at least one L-shaped bracket in relation to the hinges and hinge pins on the door jam;

an arm extending perpendicularly from the top of the plate of the at least one L-shaped bracket;

and an aperture located on a distal end of said arm of the at least one L-shaped bracket for engaging one of the hinge pins of the respective door hinge so the cabinet will pivot on said hinge and hinge pin independent of the door hanging on the same hinge and hinge pin;

a plurality of partial apertures located on an interior surface of the exterior side panel;

said plurality of partial apertures extending a predetermined distance through the exterior side panel and terminating prior to an exterior surface of the exterior side panel so no apertures are visible on the exterior surface of the exterior side panel; and at least one extension rod extending through one of the full apertures located on the interior side panel to one of the partial apertures located on the interior surface of the exterior side panel so that the extension rod is parallel to the top panel and the bottom panel.

2. A cabinet that is mountable to hinges having hinge pins used to hang a door hung in a door jam so that said cabinet can be pivoted upon the hinge pins independently of the door, said cabinet comprising:

a top panel, a bottom panel, a rear panel, an interior side panel and an exterior side panel;

a plurality of full apertures located on the interior side panel that extend from an exterior surface of the interior panel to an interior surface of the interior panel;

at least one L-shaped bracket comprising a plate having a top, a bottom, sides and at least one aperture located on the plate;

said at least one L-shaped bracket is adjustably attachable to any single full aperture of the plurality of full apertures via at least one nut and at least one bolt so as to adjust to the vertical location of the location of the at least one L-shaped bracket in relation to the hinges and hinge pins on the door jam;

an arm extending perpendicularly from the top of the plate of the at least one L-shaped bracket;

and an aperture located on a distal end of said arm of the at least one L-shaped bracket for engaging one of the hinge pins of the respective door hinge so the cabinet will pivot on said hinge and hinge pin independent of the door hanging on the same hinge and hinge pin;

a plurality of partial apertures located on an interior surface of the exterior side panel;

said plurality of partial apertures extending a predetermined distance through the exterior side panel and terminating prior to an exterior surface of the exterior side panel so no apertures are visible on the exterior surface of the exterior side panel;

at least one extension rod extending through one of the full apertures located on the interior side panel and into one of the partial apertures located on the interior surface of the exterior side panel so that the extension rod is parallel to the top panel and the bottom panel; and a securing means for locking the at least one retention rod in place to prevent the at least one retention rod from sliding back through the full aperture.

3. A cabinet that is mountable to hinges having hinge pins used to hang a door hung in a door jam so that said cabinet can be pivoted upon the hinge pins independently of the door, said cabinet comprising:

a top panel, a bottom panel, a rear panel, an interior side panel and an exterior side panel;

a plurality of full apertures located on the interior side panel that extend from an exterior surface of the interior panel to an interior surface of the interior panel;

at least one L-shaped bracket comprising a plate having a top, a bottom, sides and at least one aperture located on the plate;

said at least one L-shaped bracket is adjustably attachable to any single full aperture of the plurality of full apertures via at least one nut and at least one bolt so as to adjust to the vertical location of the location of the at least one L-shaped bracket in relation to the hinges and hinge pins on the door jam;

an arm extending perpendicularly from the top of the plate of the at least one L-shaped bracket;

and an aperture located on a distal end of said arm of the at least one L-shaped bracket for engaging one of the hinge pins of the respective door hinge so the cabinet will pivot on said hinge and hinge pin independent of the door hanging on the same hinge and hinge pin;

a plurality of partial apertures located on an interior surface of the exterior side panel;

said plurality of partial apertures extending a predetermined distance through the exterior side panel and terminating prior to an exterior surface of the exterior side panel so no apertures are visible on the exterior surface of the exterior side panel;

at least one extension rod extending through one of the full apertures located on the interior side panel and into one of the partial apertures located on the interior surface of the exterior side panel so that the extension rod is parallel to the top panel and the bottom panel; and a washer for locking the at least one retention rod in place to prevent the at least one retention rod from sliding back through the full aperture.

* * * * *